US009081339B2

(12) United States Patent
Tang et al.

(10) Patent No.: US 9,081,339 B2
(45) Date of Patent: Jul. 14, 2015

(54) FIXING DEVICE AND IMAGE FORMATION DEVICE

(71) Applicants: Chaoqian Tang, Shanghai (CN); Baolin Zhang, Shanghai (CN); Jihua Zhang, Shanghai (CN); Wei Li, Shanghai (CN); Kazuya Iwasaki, Saitama (JP)

(72) Inventors: Chaoqian Tang, Shanghai (CN); Baolin Zhang, Shanghai (CN); Jihua Zhang, Shanghai (CN); Wei Li, Shanghai (CN); Kazuya Iwasaki, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/514,896

(22) Filed: Oct. 15, 2014

(65) Prior Publication Data

US 2015/0104209 A1 Apr. 16, 2015

(30) Foreign Application Priority Data

Oct. 16, 2013 (CN) ..... 2013 1 0484908

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2078
USPC ..... 399/67, 69, 70, 334
See application file for complete search history.

(56) References Cited

U.S. PATENT DOCUMENTS

2011/0229180 A1* 9/2011 Saito ..... 399/69
2011/0305474 A1* 12/2011 Tanaka et al. ..... 399/69
2013/0004193 A1* 1/2013 Park et al. ..... 399/69

* cited by examiner

*Primary Examiner* — Hoang Ngo
(74) *Attorney, Agent, or Firm* — Harness, Dickey & Pierce, P.L.C.

(57) ABSTRACT

Disclosed are a fixing device and an image formation device. The fixing device includes first and second sensors used to respectively detect first and second temperatures; first and second calculators used to respectively calculate, during a process of starting a heating source, first and second temperature gradients; a parameter storage used to store at least first and second temperature gradient thresholds; a determination part used to get a determination result; an information generation part used to generate, based on the determination result, restart prompt information indicating that the image formation device needs to be restarted because the voltage of an electrical source is too low; and an information transmission part used to transmit the restart prompt information to a display device.

13 Claims, 12 Drawing Sheets

FIXING DEVICE AND IMAGE FORMATION DEVICE

BACKGROUND OF THE INVENTION

1. Field of the Invention

The present invention relates to a fixing device and image formation device.

2. Description of the Related Art

In a fixing device of an image formation device such as a printer, a fax machine, or a copier, there is a fixing roller in which a heating source is provided. After the fixing device receives an image formation instruction, it starts to provide the electricity to the heating source so as to preheat the fixing roller. In this preheating process, the surface temperature of the fixing roller may rise, and its temperature rise rate may be represented by a surface temperature rise value of the fixing roller within, for example, 1.5 seconds, i.e., may be represented by a temperature gradient. In a case where a standard voltage is 220 V, if the fixing roller itself works normally, then the temperature gradient of the fixing roller may be greater than or equal to 7 degrees C. If the temperature gradient is less than 7 degrees C., then the image formation device may determine that the fixing roller temperature gradient is abnormal, and after that, may stop heating the fixing roller so as to avoid a hidden danger such as smoking or a paper jam.

The problem that causes the temperature gradient of the fixing roller to be less than 7 degrees C. may be a hardware problem of the fixing roller itself or a circuit malfunction of the image formation device. Due to the hardware problem of the fixing roller itself, the fixing roller cannot be sufficiently heated by the heating source. As a result, the surface temperature rises slowly so that the temperature gradient of the fixing roller is less than 7 degrees C. Accordingly, the image formation device may display the hardware problem on a display interface so as to prompt its user to make a request for repairment. For example, in an area where electrical infrastructure construction is not well done, the electricity cannot be sufficiently supplied; this may result in a low voltage of an electric wireline. In addition, when the electricity is supplied again to the electric wireline after power cut, the electricity may be simultaneously supplied to many apparatuses which worked when the power cut occurred. As a result, electric power demands are getting concentrated at this time; this may result in a short-time low voltage. If the fixing device is started by utilizing this kind of low voltage, then the fixing roller may not be sufficient heated by the heating source, and the temperature gradient may be less than 7 degrees C. Accordingly, this may increase the probability of reporting an error of the image formation device.

However, a conventional image formation device cannot inform its user of the reason for the above-described malfunction without delay. As a result, the user may think that the reason is a hardware problem having occurred in the image formation device. That is to say, perhaps the user will put a lot of effort into finding the reason, or will make a request for repairment. In addition, if the voltage of an electric wireline in the area where the user lives is not stable, then the image formation device may be normally started sometimes, and may be abnormally started sometimes. In this case, the user may think that the quality of the image formation device is not good. That is to say, perhaps the user will make a complaint to the manufacturer of the image formation device. On the other hand, upon receipt of the report, a maintenance worker may carry out detection with respect to the image formation device. However, since the image formation device itself does not have any problem, if the voltage of the electric wireline is restored to normal by the maintenance worker when he carries out the detection, then the image formation device can be started normally. That is to say, the maintenance worker cannot rapidly find the malfunction reason; as a result, perhaps he will have to replace some components. These kinds of problems may not only bring inconvenience to the user and maintenance worker but also increase the after-sale service cost of the manufacturer.

SUMMARY OF THE INVENTION

In light of the above-described problems, the aim of the present invention is to provide a fixing device and an image formation device which are capable of informing a user of malfunction information indicating that the image formation device cannot be started due to a low voltage.

In order to achieve the aim of the present invention, the following structures and methods are adopted.

<Structure 1>

A fixing device is provided which is communicatingly connected to a display device and is installed in an image formation device to which the electricity is supplied by an electrical source. The fixing device has a fixing roller in which there is a heating source. The fixing roller has a paper passing zone located in a middle portion of the fixing roller and a non-paper passing zone located at each end of the fixing roller, and further comprises:

a paper passing zone temperature sensor (hereinafter, also called a "first sensor") used to detect a temperature of the paper passing zone to serve as a paper passing zone temperature (hereinafter, also called a "first temperature");

a non-paper passing zone temperature sensor (hereinafter, also called a "second sensor") used to detect a temperature of one of the non-paper passing zones to serve as a non-paper passing zone temperature (hereinafter, also called a "second temperature");

a paper passing zone temperature gradient calculator (hereinafter, also called a "first calculator") used to, during a process of starting the heating source, calculate a surface temperature rise value base on the first temperature in a predetermined time period to serve as a paper passing zone temperature gradient (hereinafter, also called a "first temperature gradient");

a non-paper passing zone temperature gradient calculator (hereinafter, also called a "second calculator") used to, during the process of starting the heating source, calculate a surface temperature rise value based on the second temperature in the predetermined time period to serve as a non-paper passing zone temperature gradient (hereinafter, also called a "second temperature gradient");

a parameter storage used to store at least a predetermined paper passing zone temperature gradient threshold (hereinafter, also called a "first temperature gradient threshold") and predetermined non-paper passing zone temperature gradient threshold (hereinafter, also called a "second temperature gradient threshold");

a determination part used to determine whether the second temperature gradient is greater than the second temperature gradient threshold, if it is determined that the second temperature gradient is less than or equal to the second temperature gradient threshold, then to determine that the voltage of the electrical source is too low, and to continue to determine at least once whether the first temperature gradient is greater than the first temperature gradient threshold, so as to get a determination result;

an information generation part used to, based on the determination result, generate restart prompt information indicating that the image formation device needs to be restarted because the voltage of the electrical source is too low; and an information transmission part used to transmit the restart prompt information to the display device.

<Method 1>

A fixing roller state detection method is provided for detecting a temperature of a fixing roller within a fixing device communicatingly connected to a display device and installed in an image formation device to which the electricity is supplied by an electrical source. The fixing roller, in which there is a heating source, has a paper passing zone located in a middle portion of the fixing roller and a non-paper passing zone located at each end of the fixing roller. The fixing roller state detection method comprises:

a step of setting a paper passing zone temperature sensor (a first sensor) and a non-paper passing zone temperature sensor (a second sensor) in the paper passing zone and one of the non-paper passing zones, respectively;

a step of detecting, by adopting the first and second sensors, temperatures of the paper passing zone and the one of the non-paper passing zones to serve as a paper passing zone temperature (a first temperature) and a non-paper passing zone temperature (a second temperature), respectively;

a step of calculating, by adopting a paper passing zone temperature gradient calculator (a first calculator) and a non-paper passing zone temperature gradient calculator (a second calculator), surface temperature rise values based on the first and second temperatures in a predetermined time period during a process of starting the heating source to serve as a paper passing zone temperature gradient (a first temperature gradient) and a non-paper passing zone temperature gradient (a second temperature gradient), respectively;

a step of storing, by adopting a parameter storage, at least a predetermined paper passing zone temperature gradient threshold (a first temperature gradient threshold) and a predetermined non-paper passing zone temperature gradient threshold (a second temperature gradient threshold);

a step of determining, by adopting a determination part, whether the second temperature gradient is greater than the second temperature gradient threshold, if it is determined that the second temperature gradient is less than or equal to the second temperature gradient threshold, then determining that the voltage of the electrical source is too low, and continuing to determine at least once whether the first temperature gradient is greater than the first temperature gradient threshold, so as to get a determination result;

a step of generating based on the determination result, by adopting an information generation part, restart prompt information indicating that the image formation device needs to be restarted because the voltage of the electrical source is too low; and a step of transmitting, by adopting an information transmission part, the restart prompt information to the display device.

<Structure 2>

An image formation device is provided which comprises a fixing device having Structure 1.

<structure 3>

A fixing device is provided which is communicatingly connected to a display device and is installed in an image formation device to which the electricity is supplied by an electrical source. The fixing device has a fixing roller in which there is a heating source. The fixing roller has a paper passing zone located in a middle portion of the fixing roller and a non-paper passing zone located at each end of the fixing roller, and further comprises:

a paper passing zone temperature sensor (a first sensor) used to detect a temperature of the paper passing zone to serve as a paper passing zone temperature (a first temperature);

a non-paper passing zone temperature sensor (a second sensor) used to detect a temperature of one of the non-paper passing zones to serve as a non-paper passing zone temperature (a second temperature);

a paper passing zone temperature gradient calculator (a first calculator) used to, during a process of starting the heating source, calculate a surface temperature rise value base on the first temperature in a predetermined time period to serve as a paper passing zone temperature gradient (a first temperature gradient);

a non-paper passing zone temperature gradient calculator (a second calculator) used to, during the process of starting the heating source, calculate a surface temperature rise value based on the second temperature in the predetermined time period to serve as a non-paper passing zone temperature gradient (a second temperature gradient);

a difference calculator used to, during the process of starting the heating source, calculate an absolute difference of the first and second temperature gradients to serve as a temperature gradient difference;

a parameter storage used to store at least a predetermined non-paper passing zone temperature gradient threshold (a second temperature gradient threshold) and a predetermined temperature gradient difference threshold (hereinafter, also called a "third temperature gradient threshold");

a determination part used to determine whether the second temperature gradient is greater than the second temperature gradient threshold, if it is determined that the second temperature gradient is less than or equal to the second temperature gradient threshold, then to determine that the voltage of the electrical source is too low, and to continue to determine at least once whether the temperature gradient difference is greater than the third temperature gradient threshold, so as to get a determination result;

an information generation part used to, based on the determination result, generate restart prompt information indicating that the image formation device needs to be restarted because the voltage of the electrical source is too low; and an information transmission part used to transmit the restart prompt information to the display device.

<Method 2>

A fixing roller state detection method is provided for detecting a temperature of a fixing roller within a fixing device communicatingly connected to a display device and installed in an image formation device to which the electricity is supplied by an electrical source. The fixing roller, in which there is a heating source, has a paper passing zone located in a middle portion of the fixing roller and a non-paper passing zone located at each end of the fixing roller. The fixing roller state detection method comprises:

a step of setting a paper passing zone temperature sensor (a first sensor) and a non-paper passing zone temperature sensor (a second sensor) in the paper passing zone and one of the non-paper passing zones, respectively;

a step of detecting, by adopting the first and second sensors, temperatures of the paper passing zone and the one of the non-paper passing zones to serve as a paper passing zone temperature (a first temperature) and a non-paper passing zone temperature (a second temperature), respectively;

a step of calculating, by adopting a paper passing zone temperature gradient calculator (a first calculator) and a non-paper passing zone temperature gradient calculator (a second calculator), surface temperature rise values based on the first and second temperatures in a predetermined time period during a process of starting the heating source to serve as a paper passing zone temperature gradient (a first temperature gradient) and a non-paper passing zone temperature gradient (a second temperature gradient), respectively;

a step of calculating, by adopting a difference calculator, an absolute difference of the first and second temperature gradients to serve as a temperature gradient difference;

a step of storing, by adopting a parameter storage, at least a predetermined non-paper passing zone temperature gradient threshold (a second temperature gradient threshold) and a predetermined temperature gradient difference threshold (a third temperature gradient threshold);

a step of determining, by adopting a determination part, whether the second temperature gradient is greater than the second temperature gradient threshold, if it is determined that the second temperature gradient is less than or equal to the second temperature gradient threshold, then determining that the voltage of the electrical source is too low, and continuing to determine at least once whether the temperature gradient difference is greater than the third temperature gradient threshold, so as to get a determination result;

a step of generating based on the determination result, by adopting an information generation part, restart prompt information indicating that the image formation device needs to be restarted because the voltage of the electrical source is too low; and a step of transmitting, by adopting an information transmission part, the restart prompt information to the display device.

<structure 4>

An image formation device is provided which comprises a fixing device having Structure 3.

<Function and Effect>

According to the fixing devices and image formation devices, the first and second calculators are capable of calculating, during the process of starting the heating source, the first and second temperature gradients based on the first and second temperatures; the determination part is capable of determining, based on the relationship of the second temperature gradient and second temperature gradient threshold, that the voltage of the electrical source is too low, and in this case, further conducting a determination at least once so as to get a determination result; the information generation part is capable of generating, based on the determination result, restart prompt information; and the information transmission part is capable of transmitting the restart prompt information to the display device for display. At this time, a user may know, based on the restart prompt information, that the malfunction reason is that the voltage of the electrical source is too low, but is not a hardware problem of the fixing device itself. As a result, it is possible to save the time of finding the malfunction reason and making a request for repairment, and is possible to decrease the after-sale service cost of the manufacturer.

DETAILED DESCRIPTION OF THE PREFERRED EMBODIMENTS

Figure 1:
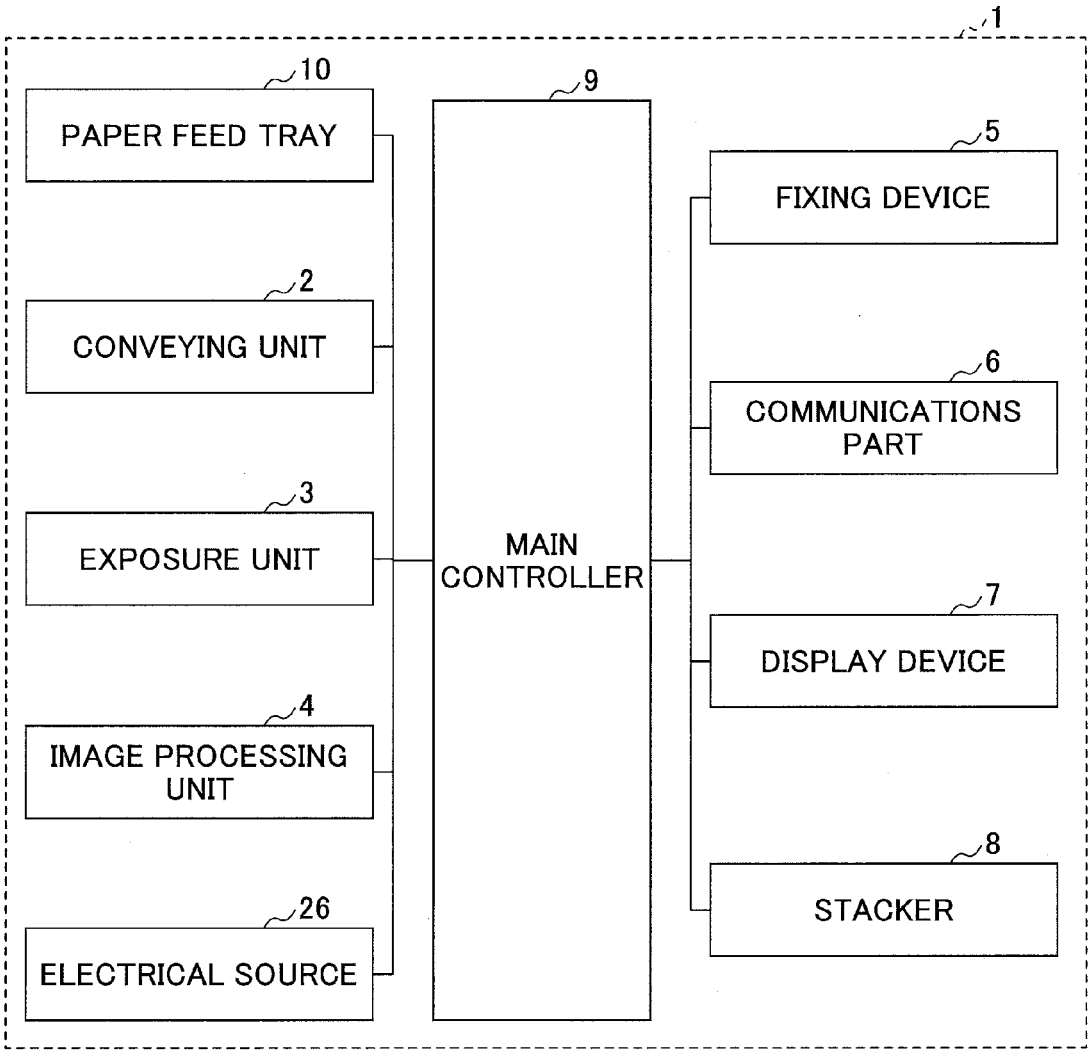
FIG. 1 is a block diagram of an image formation device according to Embodiment 1 of the present invention.

In order to let those people skilled in the art better understand the present invention, hereinafter the present invention will be concretely described on the basis of the drawings and various embodiments.

According to a first aspect of the present invention, a fixing device is provided which is communicatingly connected to a display device and is installed in an image formation device to which the electricity is supplied by an electrical source. The fixing device has a fixing roller in which there is a heating source. The fixing roller has a paper passing zone located in a middle portion of the fixing roller and a non-paper passing zone located at each end of the fixing roller, and further comprises a first sensor used to detect the temperature of the paper passing zone to serve as a first temperature; a second sensor used to detect the temperature of one of the non-paper passing zones to serve as a second temperature; a first calculator used to, during a process of starting the heating source, calculate a surface temperature rise value based on the first temperature in a predetermined time period to serve as a first temperature gradient; a second calculator used to, during the process of starting the heating source, calculate a surface temperature rise value based on the second temperature in the predetermined time period to serve as a second temperature gradient; a parameter storage used to store at least first and second temperature gradient thresholds; a determination part used to determine whether the second temperature gradient is greater than the second temperature gradient threshold, and if it is determined that the second temperature gradient is less than or equal to the second temperature gradient threshold, then to determine that the voltage of the electrical source is too low, and to continue to determine at least once whether the first temperature gradient is greater than the first temperature gradient threshold, so as to get a determination result; an information generation part used to, based on the determination result, generate restart prompt information indicating that the image formation device needs to be restarted because the voltage of the electrical source is too low; and an information transmission part used to transmit the restart prompt information to the display device for display.

In an example, the fixing device further comprises a sampling controller. After the heating source is started, the sampling controller controls the first sensor to detect a first temperature on the basis of a predetermined sampling frequency. The parameter storage further stores a predetermined threshold. After a predetermined start time, the first calculator calculates, on the basis of the predetermined sampling frequency, the first temperature gradient plural times. After it is determined that the voltage of the electrical source is too low, the determination part continues to determine plural times whether the first temperature gradient is greater than the first temperature gradient threshold. At the same time, the determination part lets the number of times, that the first temperature gradient is continuously greater than or equal to the first temperature gradient threshold, be a count value, and determines whether the count value is greater than or equal to the predetermined threshold. If a determination result is obtained which indicates that the count value is greater than or equal to the predetermined threshold, then the information generation part generates the restart prompt information on the basis of the determination result.

In an example, the fixing device further comprises a power supply used to supply the electricity to the heating source. The heating source corresponds to a predetermined voltage, and is started by an actual voltage supplied by the electrical source. After the determination result is obtained which indicates that the count value is less than the predetermined threshold, the power supply stops supplying the electricity to the heating source. After a predetermined waiting time, the power supply resupplies the electricity to the heating source so that the heating source is restarted.

In an example, the predetermined time period is 1.5 seconds, the predetermined sampling frequency is 10 Hz, the predetermined start time is 1.5 seconds, and the predetermined waiting time is less than 2 minutes. The first temperature gradient threshold is predetermined on the basis of the first temperature gradient of the fixing roller when a paper jam occurs under 110% of the predetermined voltage, or is predetermined on the basis of the first temperature gradient of the fixing roller when a paper jam does not occur under 85% of the predetermined voltage. The second temperature gradient threshold is predetermined on the basis of the second temperature gradient of the fixing roller when the heating source is started by 85%~90% of the predetermined voltage.

According to a second aspect of the present invention, a fixing roller state detection method is provided for detecting a temperature of a fixing roller within a fixing device communicatingly connected to a display device and installed in an image formation device to which the electricity is supplied by an electrical source. The fixing roller, in which there is a heating source, has a paper passing zone located in a middle portion of the fixing roller and a non-paper passing zone located at each end of the fixing roller. The fixing roller state detection method comprises a step of setting first and second sensors in the paper passing zone and one of the non-paper passing zones, respectively; a step of detecting, by adopting the first and second sensors, temperatures of the paper passing zone and the one of the non-paper passing zones to serve as first and second temperatures, respectively; a step of calculating, by adopting first and second calculators, surface temperature rise values based on the first and second temperatures in a predetermined time period during a process of starting the heating source to serve as first and second temperature gradients, respectively; a step of storing, by adopting a parameter storage, at least first and second temperature gradient thresholds; a step of determining, by adopting a determination part, whether the second temperature gradient is greater than the second temperature gradient threshold, if it is determined that the second temperature gradient is less than or equal to the second temperature gradient threshold, then determining that the voltage of the electrical source is too low, and continuing to determine at least once whether the first temperature gradient is greater than the first temperature gradient threshold, so as to get a determination result; a step of generating based on the determination result, by adopting an information generation part, restart prompt information indicating that the image formation device needs to be restarted because the voltage of the electrical source is too low; and a step of transmitting, by adopting an information transmission part, the restart prompt information to the display device for display.

In an example, the fixing roller state detection method further comprises a step of controlling, by adopting a sampling controller, the first sensor to detect the first temperature on the basis of a predetermined sampling frequency; after a predetermined start time, by adopting the first calculator, calculating the first temperature gradient plural times on the basis of the predetermined sampling frequency; after it is determined that the voltage of the electrical source is too low, by adopting the determination part, continuing to determine plural times whether the first temperature gradient is greater than the first temperature gradient threshold; at the same time, letting the number of times, that the first temperature gradient is continuously greater than or equal to the first temperature gradient threshold, be a count value; determining whether the count value is greater than or equal to a predetermined threshold; and after a determination result is obtained which indicates that the count value is greater than or equal to the predetermined threshold, by adopting the information generation part, generating the restart prompt information on the basis of the determination result.

In an example, the fixing roller state detection method further comprises a step of stopping, after the determination result is obtained which indicates that the count value is less than the predetermined threshold, supplying the electricity to the heating source from a power supply; and after a predetermined waiting time, resupplying the electricity to the heating source from the power supply so that the heating source is restarted.

According to a third aspect of the present invention, an image formation device is provided which comprises the fixing device according to the first aspect of the present invention.

According to a fourth aspect of the present invention, a fixing device is provided which is communicatingly connected to a display device and is installed in an image formation device to which the electricity is supplied by an electrical source. The fixing device has a fixing roller at which there is a heating source. The fixing roller has a paper passing zone located in a middle portion of the fixing roller and a non-paper passing zone located in each end of the fixing roller, and further comprises a first sensor used to detect the temperature of the paper passing zone to serve as a first temperature; a second sensor used to detect the temperature of one of the non-paper passing zones to serve as a second temperature; a first calculator used to, during a process of starting the heating source, calculate a surface temperature rise value base on the first temperature in a predetermined time period to serve as a first temperature gradient; a second calculator used to, during the process of starting the heating source, calculate a surface temperature rise value based on the second temperature in the predetermined time period to serve as a second temperature gradient; a difference calculator used to, during the process of starting the heating source, calculate an absolute difference of the first and second temperature gradients to serve as a temperature gradient difference; a parameter storage used to store at least second and third temperature gradient thresholds; a determination part used to determine whether the second temperature gradient is greater than the second temperature gradient threshold, if it is determined that the second temperature gradient is less than or equal to the second temperature gradient threshold, then to determine that the voltage of the electrical source is too low, and to continue to determine at least once whether the temperature gradient difference is greater than the third temperature gradient threshold, so as to get a determination result; an information generation part used to, based on the determination result, generate restart prompt information indicating that the image formation device needs to be restarted because the voltage of the electrical source is too low; and an information transmission part used to transmit the restart prompt information to the display device for display.

In an example, the fixing device further comprises a sampling controller. After the heating source is started, the sampling controller controls the first and second sensors to respectively detect the first and second temperatures on the basis of a predetermined sampling frequency. The parameter storage further stores a predetermined threshold. After a predetermined start time, the first and second calculators respectively calculate the first and second temperature gradients plural times on the basis of the predetermined sampling frequency. The difference calculator calculates the temperature gradient difference plural times on the basis of the predetermined sampling frequency. After it is determined that the voltage of the electrical source is too low, the determination part continues to determine plural times whether the temperature gradient difference is greater than the third temperature gradient threshold. At the same time, the determination part lets the number of times, that the temperature gradient difference is continuously greater than or equal to the third temperature gradient threshold, be a count value, and determines whether the count value is greater than or equal to the predetermined threshold. After a determination result is obtained which indicates that the count value is greater than or equal to the predetermined threshold, the information generation part generates the restart prompt information on the basis of the determination result.

In an example, the fixing device further comprises a power supply used to supply the electricity to the heating source. The heating source corresponds to a predetermined voltage, and is started by an actual voltage supplied by the electrical source. After the determination result is obtained which indicates that the count value is less than the predetermined threshold, the power supply stops supplying the electricity to the heating source. After a predetermined waiting time, the power supply resupplies the electricity to the heating source so that the heating source is restarted.

In an example, the predetermined time period is 1.5 seconds, the predetermined sampling frequency is 10 Hz, the predetermined start time is 1.5 seconds, and the predetermined waiting time is less than 2 minutes. The second temperature gradient threshold is predetermined on the basis of the second temperature gradient of the fixing roller when the heating source is started under 85~90% of the predetermined voltage. The third temperature gradient threshold is predetermined on the basis of the temperature gradient difference of the fixing roller when a paper jam occurs under 110% of the predetermined voltage, or is predetermined on the basis of the temperature gradient difference of the fixing roller when a paper jam does not occur under 85% of the predetermined voltage.

According to a fifth aspect of the present invention, a fixing roller state detection method is provided for detecting a temperature of a fixing roller within a fixing device communicatingly connected to a display device and installed in an image formation device to which the electricity is supplied by an electrical source. The fixing roller, in which there is a heating source, has a paper passing zone located in a middle portion of the fixing roller and a non-paper passing zone located at each end of the fixing roller. The fixing roller state detection method comprises a step of setting first and second temperature sensors in the paper passing zone and one of the non-paper passing zones, respectively; a step of detecting, by adopting the first and second sensors, temperatures of the paper passing zone and the one of the non-paper passing zones to serve as first and second temperatures, respectively; a step of calculating, by adopting first and second calculators, surface temperature rise values based on the first and second temperatures in a predetermined time period during a process of starting the heating source to serve as first and second temperature gradients, respectively; a step of calculating, by adopting a difference calculator, an absolute difference of the first and second temperature gradients to serve as a temperature gradient difference; a step of storing, by adopting a parameter storage, at least second and third temperature gradient thresholds; a step of determining, by adopting a determination part, whether the second temperature gradient is greater than the second temperature gradient threshold, if it is determined that the second temperature gradient is less than or equal to the second temperature gradient threshold, then determining that the voltage of the electrical source is too low, and continuing to determine at least once whether the temperature gradient difference is greater than the third temperature gradient threshold, so as to get a determination result; a step of generating based on the determination result, by adopting an information generation part, restart prompt information indicating that the image formation device needs to be restarted because the voltage of the electrical source is too low; and a step of transmitting, by adopting an information transmission part, the restart prompt information to the display device for display.

In an example, the fixing roller state detection method further comprises a step of respectively controlling, by adopting a sampling controller, the first and second sensors to detect the first and second temperatures on the basis of a predetermined sampling frequency; after a predetermined start time, respectively calculating, by adopting the first and second calculators, the first and second temperature gradients plural times on the basis of the predetermined sampling frequency; calculating, by adopting the difference calculator, the temperature gradient difference plural times; after it is determined that the voltage of the electrical source is too low, by adopting the determination part, continuing to determine plural times whether the temperature gradient difference is greater than the third temperature gradient threshold; letting the number of times, that the temperature gradient difference is continuously greater than or equal to the third temperature gradient threshold, be a count value; determining whether the count value is greater than or equal to a predetermined threshold; and after a determination result is obtained which indicates that the count value is greater than or equal to the predetermined threshold, by adopting the information generation part, generating the restart prompt information on the basis of the determination result.

In an example, the fixing roller state detection method further comprises a step of stopping, after the determination result is obtained which indicates that the count value is less than the predetermined threshold, supplying the electricity to the heating source from a power supply; and after a predetermined waiting time, resupplying the electricity to the heating source from the power supply so that the heating source is restarted.

According to a sixth aspect of the present invention, an image formation device is provides which comprises the fixing device according to the fourth aspect of the present invention.

Embodiment 1

FIG. 1 is a block diagram of an image formation device according to Embodiment 1 of the present invention.

As shown in FIG. 1, an image formation device 1 in this embodiment is used to fix a toner image formed on at least one recording medium as an image, and comprises a paper feed tray 10, a conveying unit 2, a exposure unit 3, an image processing unit 4, a fixing device 5, a display device 7, a stacker 8, a communications part 6, an electrical source 26, and a main controller 9 used to control them.

The paper feed tray 10 is used to hold at least one recording medium on which an image will be formed, such as a paper sheet or film.

The conveying unit 2 is used to transport the recording medium between an upstream unit and a downstream unit.

The exposure unit 3 is used to receive image data sent from an upstream unit not shown in the drawings, then to convert the image data into optical signals, and then to transmit the optical signals to the image processing unit 4.

The communications part 6 is in charge of data information exchange between an upstream unit and a downstream device. For example, the communications part 6 may transmit the optical signals sent from the exposure unit 3 to the image processing unit 4.

The image processing unit 4 is located downstream of the exposure unit 3, and on the basis of the received optical signals, causes toner to form a toner image on the recording medium. In particular, the image processing unit 4 comprises a photosensitive drum, a toner box, and a transfer roller. The toner box is used to store the toner. The photosensitive drum is used to form, on the basis of the optical signals, a corresponding electrostatic latent image on its surface, and on the basis of the electrostatic latent image, causes the toner to form a corresponding image on its surface. The transfer roller is set facing the photosensitive drum, and is used to transfer the corresponding image on the surface of the photosensitive drum to the recording medium so as to form the toner image.

The electrical source 26 is used to supply the electricity to the image formation device 1.

The display device 7 is used to display various information related to the image formation, such as restart prompt information or repairment prompt information.

The fixing device 5 is located downstream of the image processing unit 4, and by heating and pressurization, fixes the toner image formed on the recording medium on the recording medium so as to form the image.

Figure 2:
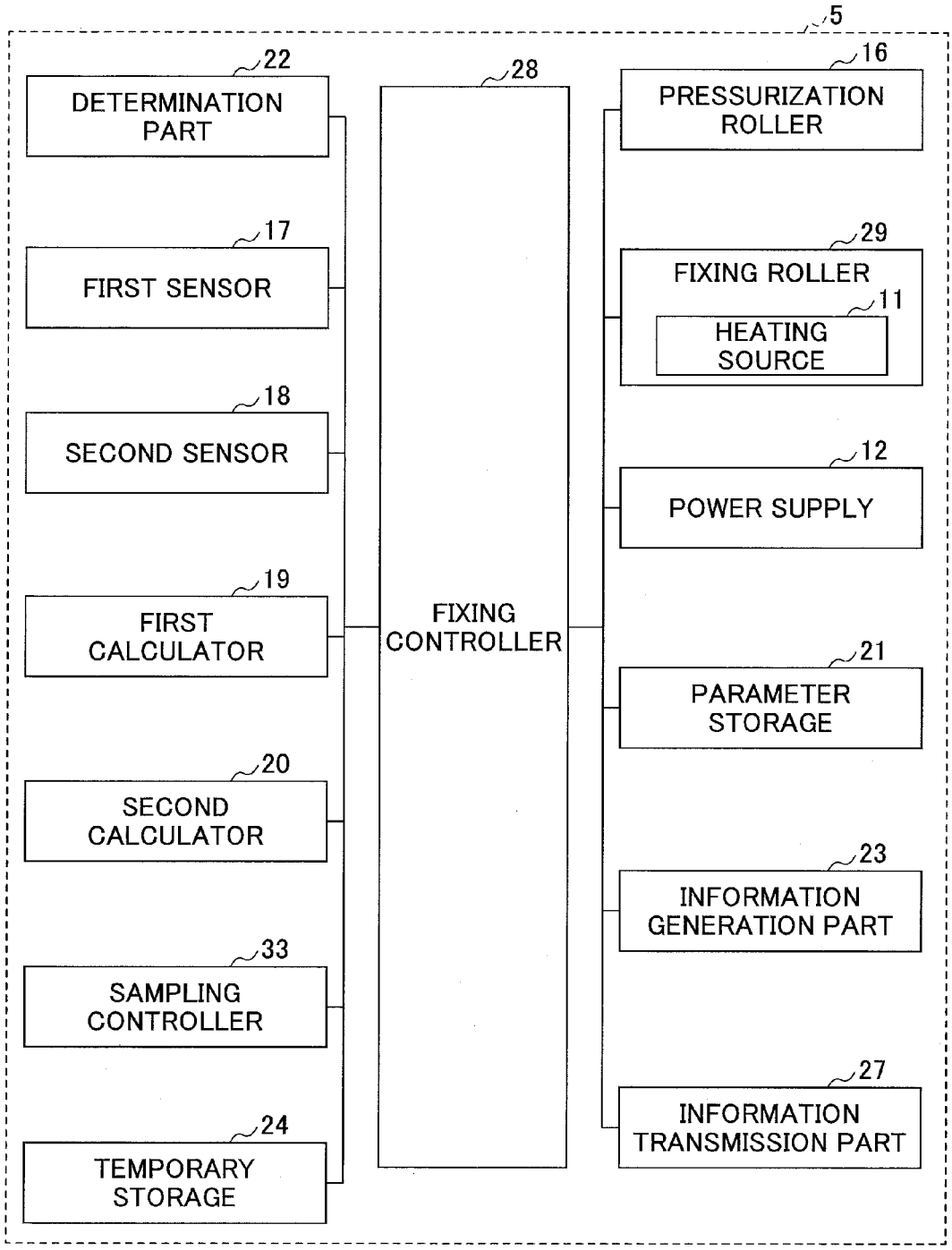
FIG. 2 is a block diagram of a fixing device according to Embodiment 1 of the present invention.

FIG. 2 is a block diagram of the fixing device 5 according to Embodiment 1 of the present invention.

As shown in FIG. 2, the fixing device 5 comprises a fixing roller 29, a heating source 11, a pressurization roller 16, a power supply 12, a first sensor 17, a second sensor 18, a first calculator 19, a second calculator 20, a parameter storage 21, a determination part 22, a temporary storage 24, an information generation part 23, an information transmission part 27, a sampling controller 33, and a fixing controller 28 used to control them.

Figure 3:
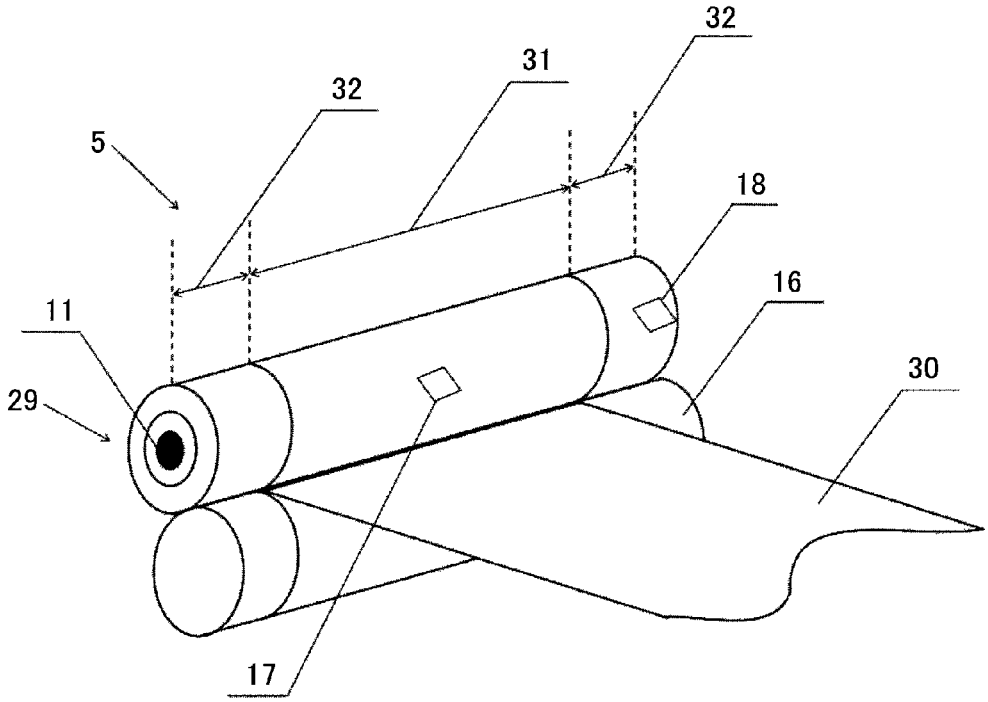
FIG. 3 illustrates positions of a paper passing zone and a non-paper passing zone of a fixing roller according to Embodiment 1 of the present invention.

FIG. 3 illustrates positions of a paper passing zone and a non-paper passing zone of the fixing roller 29 according to Embodiment 1 of the present invention.

As shown in FIG. 3, the fixing roller 29 is used to fix, by heating, a toner image on a recording medium 30 as an image, and comprises a paper passing zone 31 located in the middle portion of the fixing roller 29 and a non-paper passing zone 32 located in each end of the fixing roller 29. Since the fixing roller 29 is a long roller whose axial length is greater than the width of the recording medium 30, the recording medium 30 makes contact with only a part of the fixing roller 29. As a result, it is possible to divide, on the basis of whether the recording medium 30 makes contact with the surface of the fixing roller 29, the surface of the fixing roller 29 into a paper passing zone 31 and two non-paper passing zones 32. That is to say, a zone on the surface of the fixing roller 29 which makes contact with the recording medium 30 such as a paper sheet is called the paper passing zone 31, and other zones on the surface of the fixing roller 29 which do not make contact with the recording medium 30 are called the non-paper passing zone 32.

The heating source 11 is, for example, a halogen lamp, and is provided in the fixing roller 29 for heating the fixing roller 29. Different heating sources 11 correspond to different predetermined voltages. After the heating source 11 is started by its corresponding predetermined voltage, the temperature rise rate of the surface of the fixing roller 29 is normal. At this time, the fixing roller 29 may smoothly enter a standby state, and is prepared for forming an image. For example, the predetermined voltage is 200~240 V.

The power supply 12 is connected with the heating source 11, and is used to supply the electricity to the heating source 11. After the electrical source 26 of the image formation device 1 is started, or after the image formation device 1 in a standby state is awakened, the power supply 12 supplies the electricity to the heating source 11, and the heating source 11 is started and preheated. However, as described above, in some areas, the voltage of the wireline is not quite identical to the predetermined voltage required by the heating source 11, so that an actual voltage supplied by the power supply 12 to the heating source 11 is less than the predetermined voltage. At this time, when the heating source 11 is started, if the actual voltage is less than the predetermined voltage, for example, if the actual voltage is 170~200 V, then although the heating source 11 can be started, the temperature of the fixing roller 29 rises slowly, and it is necessary to take a long time to enter the standby state. Furthermore, if the actual voltage is less than, for example, 170 V, then the temperature of the fixing roller 29 rises more slowly. This may result in not being able to enter the standby state because the surface temperature of the fixing roller 29 cannot reach a predetermined level. At this time, it is impossible to carry out the fixing function, and in general, the image formation device 1 may show a fatal error message. For the sake of convenience, in this specification, the voltage within 200~240 V is defined as a normal voltage, the voltage within 170~200 V is defined as a low voltage, and the voltage less than 170 V is defined as an abnormally low voltage.

The pressurization roller 16 is set facing the fixing roller 29, and together with the fixing roller 29, nips and transports the recording medium 30. At the same time, the toner image is fixed on the recording medium 30 as an image by heating and pressurization.

The temporary storage 24 is used to temporarily store data detected or calculated by the respective components of the fixing device 5.

The fixing controller 28 is used to control the respective components of the fixing device 5.

Figure 4:
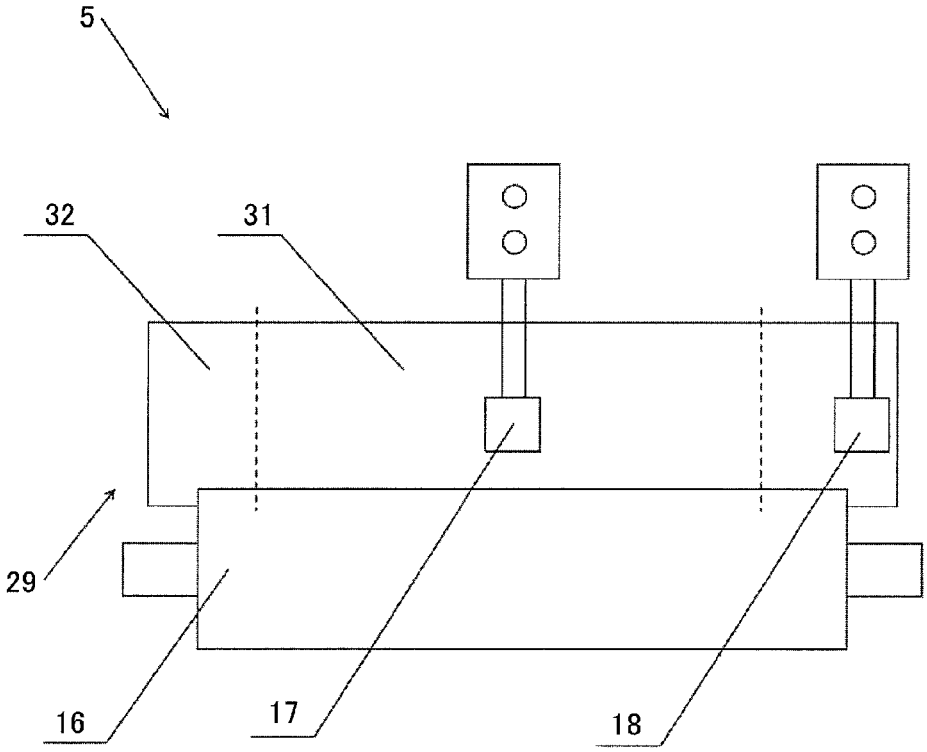
FIG. 4 illustrates positions of first and second sensors on the fixing roller according to Embodiment 1 of the present invention.

FIG. 4 illustrates positions of first and second sensors on the fixing roller 29 according to Embodiment 1 of the present invention.

As shown in FIG. 4, a first sensor 17 is disposed in the paper passing zone 31 located in the middle portion of the fixing roller 29. The first sensor 17 is used to detect the surface temperature of the paper passing zone 31 located in the middle portion, and to let the detected temperature serve as a first temperature Tc.

A second sensor 18 is disposed in one of the non-paper passing zones 32 respectively located in the two ends of the fixing roller 29. The second sensor 18 is used to detect the surface temperature of the one of the non-paper passing zones 32, and to let the detected temperature serve as a second temperature Tm.

The first calculator 19 is used to calculate, during a process in which the heating source 11 is started, a surface temperature rise value in a predetermined time period on the basis of the first temperature Tc to serve as a first temperature gradient ΔTc. The predetermined time period is, for example, 1.5 seconds. Here it is assumed that the first temperature Tc and the second temperature Tm are recorded every 0.1 seconds. That is to say, if a time point, when the first temperature Tc and the second temperature Tm are prepared to be recorded, is set to 0 seconds, then a time point, when a $1^{st}$ first temperature Tc and a $1^{st}$ second temperature Tm are recorded, is 0.1 seconds; a time point, when a $2^{nd}$ first temperature Tc and a 2nd second temperature Tm are recorded, is 0.2 seconds; and so on. As a result, if a current time point is set to t seconds, then a first temperature gradient ΔTc at the time point t (t>1.5 seconds) is $\Delta Tc_t = Tc_t - Tc_{(t-1.5)}$. In this way, for example, a first temperature gradient ΔTc at a time point 1.6 seconds is $\Delta Tc_{1.6} = Tc_{1.6} - Tc_{0.1}$; a first temperature gradient ΔTc at a time point 1.7 seconds is $\Delta Tc_{1.7} = Tc_{1.7} - Tc_{0.2}$; and so on. After the calculation, the first calculator 19 stores the first temperature gradient ΔTc in the temporary storage 24.

In the same way, the second calculator 20 is used to calculate the second temperature gradient ΔTm in the predetermined time period during the process in which the heating source 11 is started, and to store the second temperature gradient ΔTm in the temporary storage 24.

The parameter storage 21 stores a first temperature gradient threshold $\Delta T_1$, a second temperature gradient threshold $\Delta T_2$, a predetermined threshold M, a predetermined sampling frequency v, a predetermined start time $t_p$, a maximum number of sampling times $n_0$, and a predetermined waiting time $t_w$.

The first temperature gradient threshold $\Delta T_1$ is predetermined on the basis of the first temperature gradient ΔTc of the fixing roller 29 when a paper jam occurs under 110% of the predetermined voltage (for example, 220~264 V) by which the heating source 11 is started, or is predetermined on the basis of the first temperature gradient ΔTc of the fixing roller 29 when a paper jam does not occur under 85% of the predetermined voltage (for example, 170~204 V) by which the heating source 11 is started.

The second temperature gradient threshold $\Delta T_2$ is predetermined on the basis of the second temperature gradient ΔTm of the fixing roller 29 under 85~90% of the predetermined voltage (for example. 170~180 V) by which the heating source 11 is started.

The reason for the above-described determination is as follows.

When a paper jam occurs around the fixing roller 29, a paper sheet 30 is jammed between the paper passing zone 31 and the first sensor 17 in general. This may cause the first sensor 17 and the paper passing zone 31 to lose their contact. Since the paper sheet 30 has a thermal insulation function, the heat conduction from the paper passing zone 31 to the first sensor 17 becomes slow. As a result, the first temperature gradient ΔTc becomes less than a normal value. If the first temperature gradient ΔTc is less than the first temperature gradient threshold $\Delta T_1$, then the image formation device 1 may report an error. On the other hand, the non-paper passing zone 32 is not influenced by the paper jam because no paper sheet passes. As a result, the second temperature gradient ΔTm is not influenced by the paper jam, but is influenced only by the actual voltage. Therefore, it is possible to use the second temperature gradient ΔTm to distinguish between a normal voltage and a low voltage. During the process in which the heating source 11 is started, if the second temperature gradient ΔTm is less than or equal to the second temperature gradient threshold $\Delta T_2$, that means at this time, the actual voltage supplied by the power supply 12 is low; if the second temperature gradient ΔTm is greater than the second temperature gradient threshold $\Delta T_2$, that means at this time, the actual voltage supplied by the power supply 12 is normal.

The predetermined sampling frequency v is a sampling frequency of the first sensor 17, and for example, it is 10 Hz. That is to say, during the process in which the heating source 11 is started, the first sensor 17 detects the first temperature Tc every 0.1 seconds.

The determination part 22 may determine whether the second temperature gradient ΔTm is greater than the second temperature gradient threshold $\Delta T_2$; determine whether the first temperature gradient ΔTc is greater than the first temperature gradient threshold $\Delta T_1$; determine whether a count value m is greater than the predetermined threshold M; and determine whether the number of sampling times is greater than or equal to the maximum number of sampling times $n_0$. Furthermore, the determination part 22 may control the respective components of the fixing device 5 on the basis of the determination results.

The information generation part 23 is used to generate restart prompt information indicating that the image formation device 1 needs to be restarted because the actual voltage of the electrical source 26 is too low, repairment prompt information indicating that the image formation device 1 needs to be repaired because a fatal error such as a paper jam has occurred, etc.

The information transmission part 27 is used to sent the various information generated by the information generation part 23 to the display device 7 for display.

The fixing controller 28 is used to control the respective components of the fixing device 5.

According to the fixing device 5 of this embodiment, it is possible to detect and control the temperature of the fixing roller 29, and to inform the user that the malfunction of the fixing roller 29 is a paper jam having occurred around the fixing roller 29 or that the actual voltage supplied by the power supply 12 to the heating source 11 is too low. As a result, it is possible to assist the user to adopt a proper way to handle the malfunction.

In addition, a fixing roller state detection method adopted by the fixing device 5 according to this embodiment is as follows.

Figure 5:
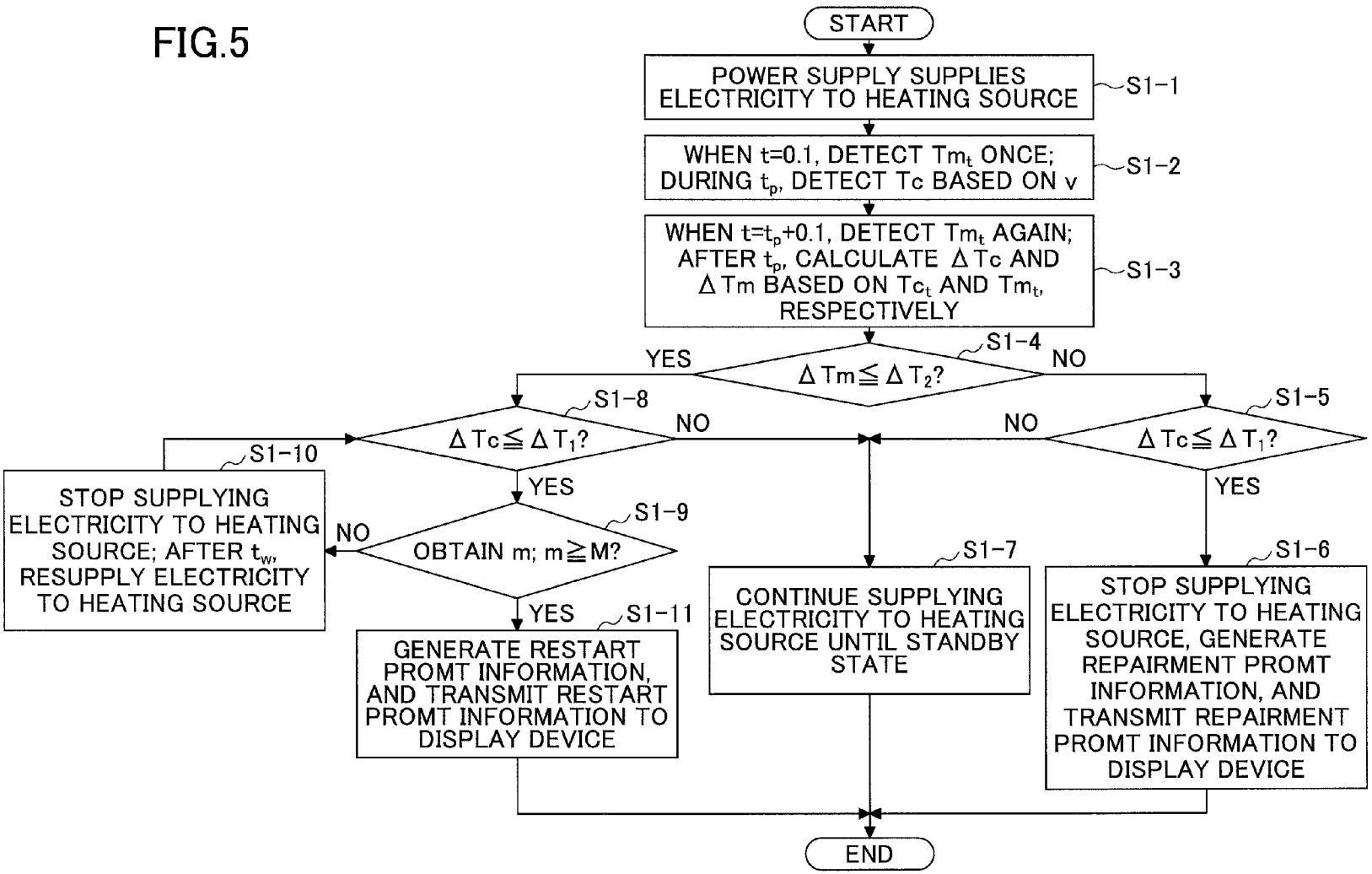
FIG. 5 is a flowchart of a fixing roller state detection method according to Embodiment 1 of the present invention.

FIG. 5 is a flowchart of a fixing roller state detection method according to Embodiment 1 of the present invention.

As shown in FIG. 5, the fixing roller state detection method according to Embodiment 1 of the present invention comprises the following steps.

STEP S1-1:

When the electrical source 26 of the image formation device 1 is started, or when the image formation device 1 in a standby state is awakened, the power supply 12 supplies the electricity to the heating source 11. After that, STEP S1-2 will be conducted.

STEP S1-2:

When t=0.1, the sampling controller 33 controls the second sensor 18 to detect once a second temperature $Tm_{0.1}$, and at the same time, controls the first sensor 17 to detect once a first temperature $Tc_{0.1}$. The second temperature $Tm_{0.1}$ and the first temperature $Tc_{0.1}$ are stored in the temporary storage 24. After that, during a predetermined start time $t_p$, the sampling controller 33 controls the first sensor 17 to detect, on the basis of a predetermined sampling frequency v, a first temperature Tc, and stores the first temperature Tc in the temporary storage 24. After that, STEP S1-3 will be conducted.

STEP S1-3:

When $t=t_p+0.1$, the sampling controller 33 controls the second sensor 18 to detect once a second temperature $Tm_{(tp+0.1)}$, and controls the first sensor 17 to detect once a first temperature $Tc_{(tp+0.1)}$. The second temperature $Tm_{(tp+0.1)}$ and the first temperature $Tc_{(tp+0.1)}$ are stored in the temporary storage 24. After the predetermined start time $t_p$, the calculator 19 and second calculator 20 respectively calculate a first temperature gradient $\Delta Tc_{(tp+0.1)}$ and a second temperature gradient $\Delta Tm_{(tp+0.1)}$ at the time point $t_p+0.1$, and stores them in the temporary storage 24. After that, STEP S1-4 is conducted.

STEP S1-4:

The determination part 22 reads, from the parameter storage 21, the second temperature gradient threshold $\Delta T_2$, then reads, from the temporary storage 24, the second temperature gradient $\Delta Tm_{(tp+0.1)}$, and then determines whether the second temperature gradient $\Delta Tm_{(tp+0.1)}$ is greater than the second temperature gradient threshold $\Delta T_2$. If it is determined that the second temperature gradient $\Delta Tm_{(tp+0.1)}$ is greater than the second temperature gradient threshold $\Delta T_2$, that means at this time, the actual voltage supplied by the electrical source 26 is normal; after that, STEP S1-5 will be conducted. If it is determined that the second temperature gradient $\Delta Tm_{(tp+0.1)}$ is less than or equal to the second temperature gradient threshold $\Delta T_2$, that means at this time, the actual voltage supplied by the electrical source 26 is too low; after that, STEP S1-8 will be conducted.

STEP S1-5:

The determination part 22 reads, from the parameter storage 21, the first temperature gradient threshold $\Delta T_1$, then reads, from the temporary storage 24, the first temperature gradient $\Delta Tc_{(tp+0.1)}$, and then determines whether the first temperature gradient $\Delta Tc_{(tp+0.1)}$ is greater than the first temperature gradient threshold $\Delta T_1$. If it is determined that the first temperature gradient $\Delta Tc_{(tp+0.1)}$ is less than or equal to the first temperature gradient threshold $\Delta T_1$, that means at this time, a paper jam may have occurred in the paper passing zone 31; after that, STEP S1-6 will be conducted. If it is determined that the first temperature gradient $\Delta Tc_{(tp+0.1)}$ is greater than the first temperature gradient threshold $\Delta T_1$, that means at this time, a paper jam does not occur; after that, STEP S1-7 will be conducted.

STEP S1-6:

The determination part 22 determines that at this time, a fatal malfunction (SC) has occurred around the fixing roller 29. The power supply 12 stops supplying the electricity to the heating source 11. At the same time, the information generation part 23 generates repairment prompt information indicating that the user needs to make a request for repairment because a paper jam has occurred, and then the information transmission part 27 transmits the repairment prompt information to the display device 7 for display. After that, the method ends.

STEP S1-7:

The power supply 12 continues supplying the electricity to the heating source 11 until the heating source enters a standby state.

STEP S1-8:

The determination part 22 reads, from the parameter storage 21, the first temperature gradient threshold $\Delta T_1$, then reads, from the temporary storage 24, the first temperature gradient $\Delta Tc_{(tp+0.1)}$, and then determines whether the first temperature gradient $\Delta Tc_{(tp+0.1)}$ is greater than the first temperature gradient threshold $\Delta T_1$. If it is determined that the first temperature gradient $\Delta Tc_{(tp+0.1)}$ is less than or equal to the first temperature gradient threshold $\Delta T_1$, that means at this time, a paper jam may have occurred in the paper passing zone 31; after that, STEP S1-9 will be conducted. If it is determined that the first temperature gradient $\Delta Tc_{(tp+0.1)}$ is greater than the first temperature gradient threshold $\Delta T_1$, that means at this time, a paper jam has not occurred in the paper passing zone 31; after that, STEP S1-7 will be conducted.

STEP S1-9:

The determination part 22 continues to determine plural times whether the first temperature gradient $\Delta Tc$ is greater than the first temperature gradient threshold $\Delta T_1$, then lets the number of times, that the first temperature gradient $\Delta Tc$ continuously is greater than or equal to the first temperature gradient threshold $\Delta T_1$, serve as a count value m, and then stores the count value m in the temporary storage 24. After that, the determination part 22 reads, from the temporary storage 24, the count value m, then reads, from the parameter storage 21, the predetermined threshold M, and then determines whether the count value m is greater than or equal to the predetermined threshold M. If a determination result is obtained which indicates that the count value m is greater than or equal to the predetermined threshold M, then STEP S1-11 will be conducted. If a determination result is obtained which indicates that the count value m is less than the predetermined threshold M, then STEP S1-10 will be conducted.

STEP S1-10:

The power supply 12 stops supplying the electricity to the heating source 11, and after the predetermined waiting time $t_w$, resupplies the electricity to the heating source 11 so that the heating source 11 is restarted. After that, STEP S1-8 will be conducted.

STEP S1-11:

The information generation part 23 determines, on the basis of the determination result indicating that the count value m is greater than or equal to the predetermined threshold M, that the actual voltage is too low, and generates restart prompt information indicating that the image formation device 1 needs to be restarted because the actual voltage generated by the electrical source 26 is too low. After that, the information transmission part 27 transmits the restart prompt information to the display device 7 for display. After that, the method ends.

In STEP S1-2, the predetermined sampling frequency v is set to 10 Hz, and the predetermined start time $t_p$ is set to 1.5 seconds.

In STEP S1-5, if the first temperature gradient $\Delta Tc_{(tp+0.1)}$ is less than or equal to the first temperature gradient threshold $\Delta T_1$, that means at this time, a paper jam may have occurred in the paper passing zone 31. The reason is that if a paper jam occurs around the fixing roller 29, then the thermal insulation function of the corresponding paper sheet may cause the first temperature gradient $\Delta Tc$ to be lower, and if the first temperature gradient $\Delta Tc_{(tp+0.1)}$ is greater than the first temperature gradient threshold $\Delta T_1$, that means the temperature of the paper passing zone 31 rises normally, i.e., a paper jam has not occurred. As a result, it is possible to detect a physical malfunction such as a paper jam by detecting the first temperature.

In STEP S1-8, since it has been determined that the actual voltage is low, if under the low voltage, the first temperature gradient $\Delta Tc$ is still greater than the first temperature gradient threshold $\Delta T_1$, that means a paper jam has not occurred in the paper passing zone 31. As a result, the fixing roller 29 works normally, and needs to be heated until it enters the standby state, so as to form an image.

In STEP S1-10, the heating source 11 is automatically restarted. The reason is that in general, a time period, during which the wireline voltage is too low, is short, for example, 5~20 seconds. If under the low voltage, the determination part 22 obtains a determination result indicating that the count value m is less than the predetermined threshold M, then after the heating source 11 is automatically restarted, the wireline voltage may have become normal, i.e., perhaps it is impossible to obtain the determination result indicating that the count value m is less than the predetermined threshold M, and perhaps the fixing roller 29 may rise normally so as to enter the standby state. In this case, the user does not need to do anything. That is to say, by automatically restarting the heating source 11, it is possible to avoid reporting an error due to a low voltage, so that it is possible to save the time of the user and to achieve malfunction self-solution. Of course, if the time period, during which the wireline voltage is too low, is too long, then the heating source 11 may be restarted frequently. This may also let the user know that the malfunction is not a physical problem of the image formation device 1 itself, but is that the actual voltage is too low. As a result, it is also possible to save the time of the user. Another reason is that in a case where the time period, during which the wireline voltage is too low, is too long, other apparatuses cannot normally work either. As a result, in this case, the user may have confidence in determining that the malfunction is not a physical problem of the image formation device 1 itself. Therefore, the predetermined waiting time $t_w$ cannot be set too long. If the predetermined waiting time $t_w$ is too long, the user may lose confidence. In this embodiment, the predetermined waiting time $t_w$ is set to less than 2 minutes.

In STEP S1-11, under the low voltage, there may also be a case where a paper jam occurs in the paper passing zone 31. However, in this step, this case is not determined. The reason is that this case is not a problem to be solved by the present invention. In fact, in a conventional image formation device, there exists a method of handling this case.

Figure 6:
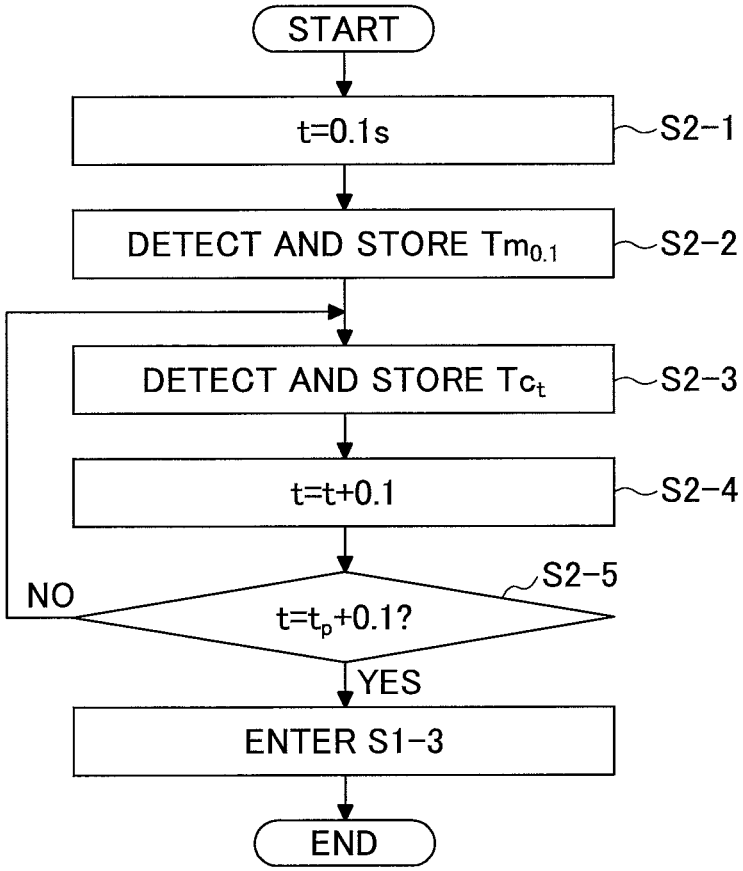
FIG. 6 is a flowchart of STEP S1-2 of the fixing roller state detection method according to Embodiment 1 of the present invention.

FIG. 6 is a flowchart of STEP S1-2 of the fixing roller state detection method according to Embodiment 1 of the present invention.

As shown in FIG. 6, STEP S1-2 of the fixing roller state detection method according to Embodiment 1 of the present invention comprises the following steps.

STEP S2-1:

If a current time t=0.1 seconds, i.e., if the current time t reaches a time point when the first sensor 17 and the second sensor 18 start to detect first samples, respectively, STEP S2-2 will be conducted.

STEP S2-2:

The sampling controller 33 controls the second sensor 18 to detect a second temperature $Tm_{0.1}$, and to store it in the temporary storage 24. After that, STEP S2-3 will be conducted.

STEP S2-3:

The sampling controller 33 controls the first sensor 17 to detect a first temperature $Tc_t$, and to store it in the temporary storage 24. After that, the STEP S2-4 will be conducted.

STEP S2-4:

If the current time t reaches t+0.1 seconds, then STEP S2-5 will be conducted.

STEP S2-5:

The determination part 22 determines whether the current time $t=t_p+0.1$ ($t_p$ is the predetermined start time). Before $t=t_p+0.1$, STEP S2-3 is conducted repeatedly. If $t=t_p+0.1$, then STEP S1-3 will be conducted.

When $t=t_p+0.1$, the first sensor 17 has detected the first temperature Tc plural times; they are $Tc_{0.1}$, $Tc_{0.2}$, . . . , $Tc_{(tp+0.1)}$, respectively. At the same time, the second sensor 18 has detected the second temperature Tm twice; they are $Tm_{0.1}$ and $Tm_{(tp+0.1)}$, respectively. In this embodiment, $t_p$=1.5 seconds. As a result, when t=1.6 seconds, the first sensor 17 has detected the first temperature Tc 16 times; they are $Tc_{0.1}$, $Tc_{0.2}$, . . . , $Tc_{1.6}$, respectively. At the same time, the second sensor 18 has detected the second temperature Tm twice; they are $Tm_{0.1}$ and $Tm_{1.6}$, respectively.

Figure 7:
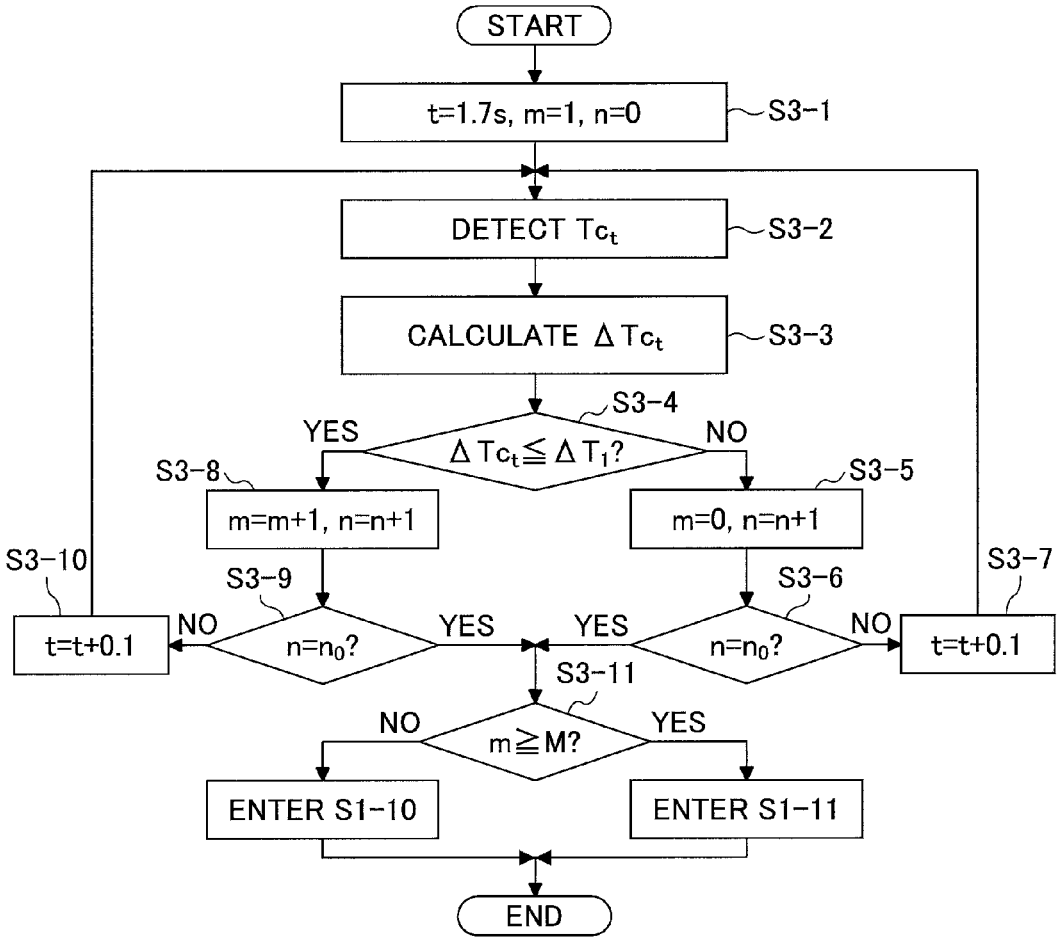
FIG. 7 is a flowchart of STEP S1-9 of the fixing roller state detection method according to Embodiment 1 of the present invention.

FIG. 7 is a flowchart of STEP S1-9 of the fixing roller state detection method according to Embodiment 1 of the present invention.

As shown in FIG. 7, STEP S1-9 of the fixing roller state detection method according to Embodiment 1 of the present invention comprises the following steps:

STEP S3-1:

The current time t reaches 1.7 seconds, a count value m is 1, and the number of sampling times is reset to 0. After that, STEP S3-2 will be conducted.

STEP S3-2:

The sampling controller 33 controls the first sensor 17 to detect a first temperature $Tc_t$ at a time point t once, and to store the first temperature $Tc_t$ in the temporary storage 24, After that, STEP S3-3 will be conducted.

STEP S3-3:

The first temperature gradient calculator 19 calculates a first temperature gradient $\Delta Tc_t=Tc_t-Tc_{(t-1.5)}$ at the time point t. After that, STEP S3-4 will be conducted.

STEP S3-4:

The determination part 22 reads, from the parameter storage 21, the first temperature gradient threshold $\Delta T_1$, then reads, from the temporary storage 24, the first temperature gradient $\Delta Tc_t$ at the time point t, and determines whether the first temperature gradient $\Delta Tc_t$ at the time point t is greater than the first temperature gradient threshold $\Delta T_1$. If it is determined that the first temperature gradient $\Delta Tc_t$ at time point t is less than or equal to the first temperature gradient threshold $\Delta T_1$, then STEP S3-8 will be conducted. If it is determined that the first temperature gradient $\Delta Tc_t$ at the time point t is greater than the first temperature gradient threshold $\Delta T_1$, that means at this time, it does not occur that the first temperature gradient $\Delta Tc_t$ is continuously greater than or equal to the first temperature gradient threshold $\Delta T_1$, then STEP S3-5 will be conducted.

STEP S3-5:

The count value m is reset to 0, and the number of sampling times n=n+1. After that, STEP S3-6 will be conducted.

STEP S3-6:

The determination part 22 determines whether the number of sampling times n reaches the maximum number of sampling times $n_0$. If it is determined that the number of sampling times n does not reach the maximum number of sampling times $n_0$, then STEP S3-7 will be conducted. If it is determined that the number of sampling times n reaches the maximum number of sampling times $n_0$, then STEP S3-11 will be conducted.

STEP S3-7:

The current time t=t+0.1 seconds. After that, STEP S3-2 will be conducted.

STEP S3-8:

The count value m=m+1, and the number of sampling times n=n+1. After that, STEP S3-9 will be conducted.

STEP S3-9:

The determination part 22 determines whether the number of sampling times n reaches the maximum number of sampling times $n_0$. If it is determined that the number of sampling times n does not reach the maximum number of sampling times $n_0$, then STEP S3-10 is conducted. If it is determined that the number of sampling times n reaches the maximum number of sampling times $n_0$, then STEP S3-11 is conducted.

STEP S3-10:

The current time t=t+0.1 seconds. After that, STEP S3-2 will be conducted.

STEP S3-11:

The determination part 22 determines whether the count value m is greater than or equal to the predetermined threshold M. If a determination result is obtained which indicates that the count value m is greater than or equal to the predetermined threshold M, STEP S1-11 will be conducted. If a determination result is obtained which indicates that the count value m is less than the predetermined threshold M, then STEP S1-10 will be conducted.

In STEP S3-6, the purpose of setting the maximum number of sampling times $n_0$ is to let the first sensor 17 detect enough samples (i.e., first temperatures) so as to let the determination result be more accurate. The predetermined threshold M is set to, for example, 2~5 times, and the purpose of determining plural times whether at the time point t, the first temperature gradient $\Delta Tc_t$ is greater than the first temperature gradient threshold $\Delta T_1$ is to improve the determination accuracy. However, if the predetermined threshold M is set too large, then the waiting time of the user will be too long; of course, this is not good.

Figure 8:
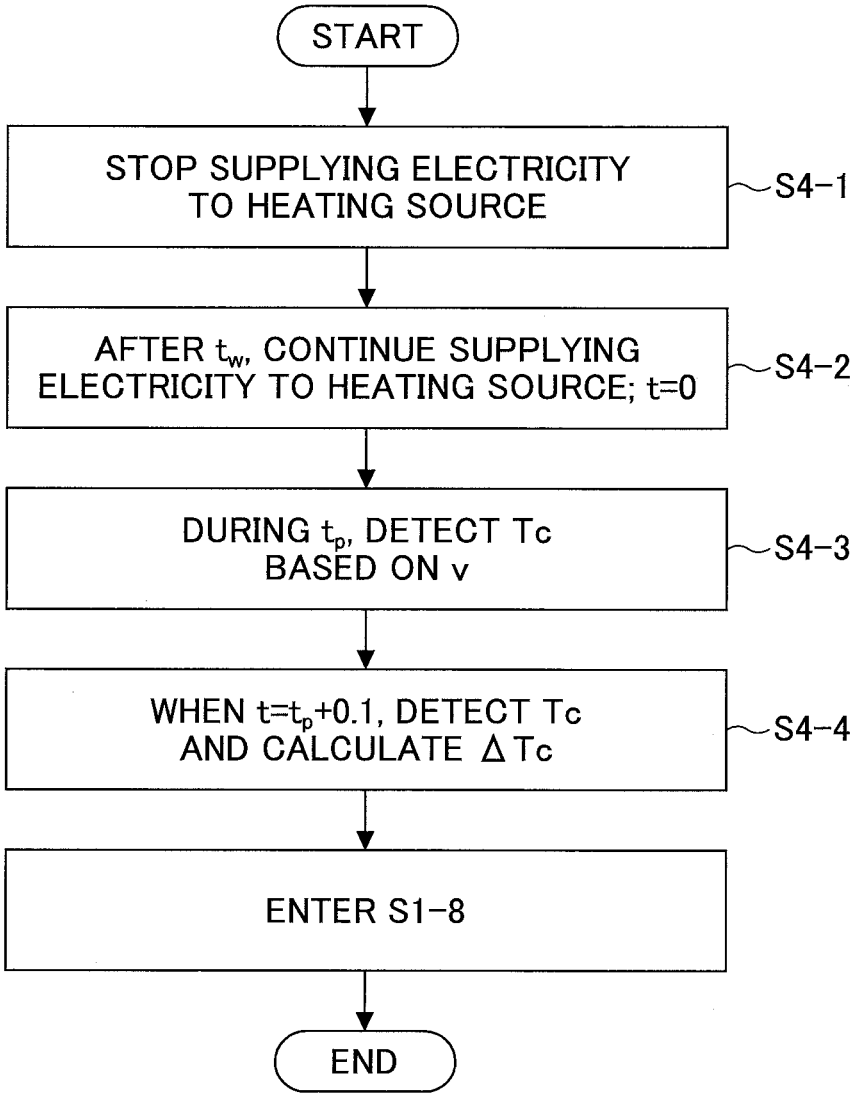
FIG. 8 is a flowchart of STEP S1-10 of the fixing roller state detection method according to Embodiment 1 of the present invention.

FIG. 8 is a flowchart of STEP S1-10 of the fixing roller state detection method according to the Embodiment 1 of the present invention.

As shown in FIG. 8, STEP S1-10 of the fixing roller state detection method according to Embodiment 1 of the present invention comprises the following steps.

STEP S4-1:

The power supply 12 stops supplying electricity to the heating source 11. After that, STEP S4-2 will be conducted.

STEP S4-2:

The power supply 12 resupplies the electricity to the heating source 11 after the predetermined waiting time $t_w$ so that the heating source 11 is restarted. At the same time, the current time is reset to 0. After that, STEP S4-3 will be conducted.

STEP S4-3:

During the predetermined start time $t_p$, the sampling controller 33 controls the first sensor 17 to detect, on the basis of the predetermined sampling frequency v, a first temperature Tc, and to store it in the temporary storage 24. After that, STEP S4-4 will be conducted.

STEP S4-4:

After the predetermined start time $t_p$, when t=t+0.1, the first temperature gradient calculator 19 calculates the corresponding first temperature gradient ΔTc, and stores it in the temporary storage 24. After that, STEP S1-8 will be conducted.

In STEP S4-2, the predetermined waiting time $t_w$ is set less than 2 minutes.

To sum up, at the time point t, the first temperature gradient $\Delta Tc_t$ is calculated by the following.

When t=1.6, the first temperature gradient is $\Delta Tc_{1.6}=Tc_{1.6}-Tc_{0.1}$;

When t=1.7, the first temperature gradient is $\Delta Tc_{1.7}=Tc_{1.7}-Tc_{0.2}$;

When t=1.8, the first temperature gradient is $\Delta Tc_{1.8}=Tc_{1.8}-Tc_{0.3}$;

. . . ; and

When t=t, the first temperature gradient is $\Delta Tc_t=Tc_t-Tc_{(t-1.5)}$.

Moreover, at the time point t, the second temperature gradient $\Delta Tm_t$ is calculated by the following.

When t=1.6, the second temperature gradient is $\Delta Tm_{1.6}=Tm_{1.6}-Tm_{0.1}$;

When t=1.7, the second temperature gradient is $\Delta Tm_{1.7}=Tm_{1.7}-Tm_{0.2}$;

When t=1.8, the second temperature gradient is $\Delta Tm_{1.8}=Tm_{1.8}-Tm_{0.3}$;

. . . ; and

When t=t, the second temperature gradient is $\Delta Tm_t=Tm_t-Tm_{(t-1.5)}$.

<Function and Effect of Embodiment 1>

In the fixing device and image formation device according to this embodiment, the first and second calculators are able to calculate, during the process of starting the heating source, the first and second temperature gradients on the basis of the first and second temperatures detected by the first and second sensors, respectively; the determination part is able to determine, on the basis of the relationship of the second temperature gradient and second temperature gradient threshold, that the actual voltage supplied by the electrical source is normal or too low, and if the actual voltage is too low, is able to further determine at least once whether the first temperature gradient is greater than the first temperature gradient threshold, so as to obtain a determination result; the information generation part is able to generate, on the basis of the determination result, restart prompt information; and, the information transmission part is able to transmit the restart prompt information to the user. As a result, the user is able to know, on the basis of the restart prompt information, that the malfunction at this time is actually caused by too a low voltage, but is not caused by a hardware problem of the fixing device itself. That is to say, only by simply restarting the image formation device according to the restart prompt information, it is possible to solve the malfunction at this time. In this way, the user does not need to make a request for repairment so that it is possible to save the time of finding the malfunction reason and requesting repairment as well as to reduce the after-sale service cost of the manufacturer.

On the other hand, if the determination part determines that the number of times, that the first temperature gradient is continuously greater than or equal to the first temperature gradient threshold, is less than the predetermined threshold, then the power supply is able to stop supplying the electricity to the heating source, and is able to let the heating source be restarted. After the heating source is restarted, if the voltage is normal, then it is possible to solve the problem that the fixing roller works abnormally due to a low voltage. In this way, the user does not need to carry out a manual operation to solve the problem. As a result, it is possible to save the user's waiting time, and is possible to achieve malfunction self-solution.

Embodiment 2

In Embodiment 1, a determination method on the basis of the first temperature gradient ΔTc and the first temperature gradient threshold $\Delta T_1$ is adopted. Of course, it is also possible to adopt a determination method on the basis of the temperature gradient difference ΔTcm and a third temperature gradient threshold $\Delta T_3$. Here it should be noted that regarding the parts in Embodiment 2 being the same as those in Embodiment 1, the same names are adopted, and the same descriptions are omitted.

Figure 9:
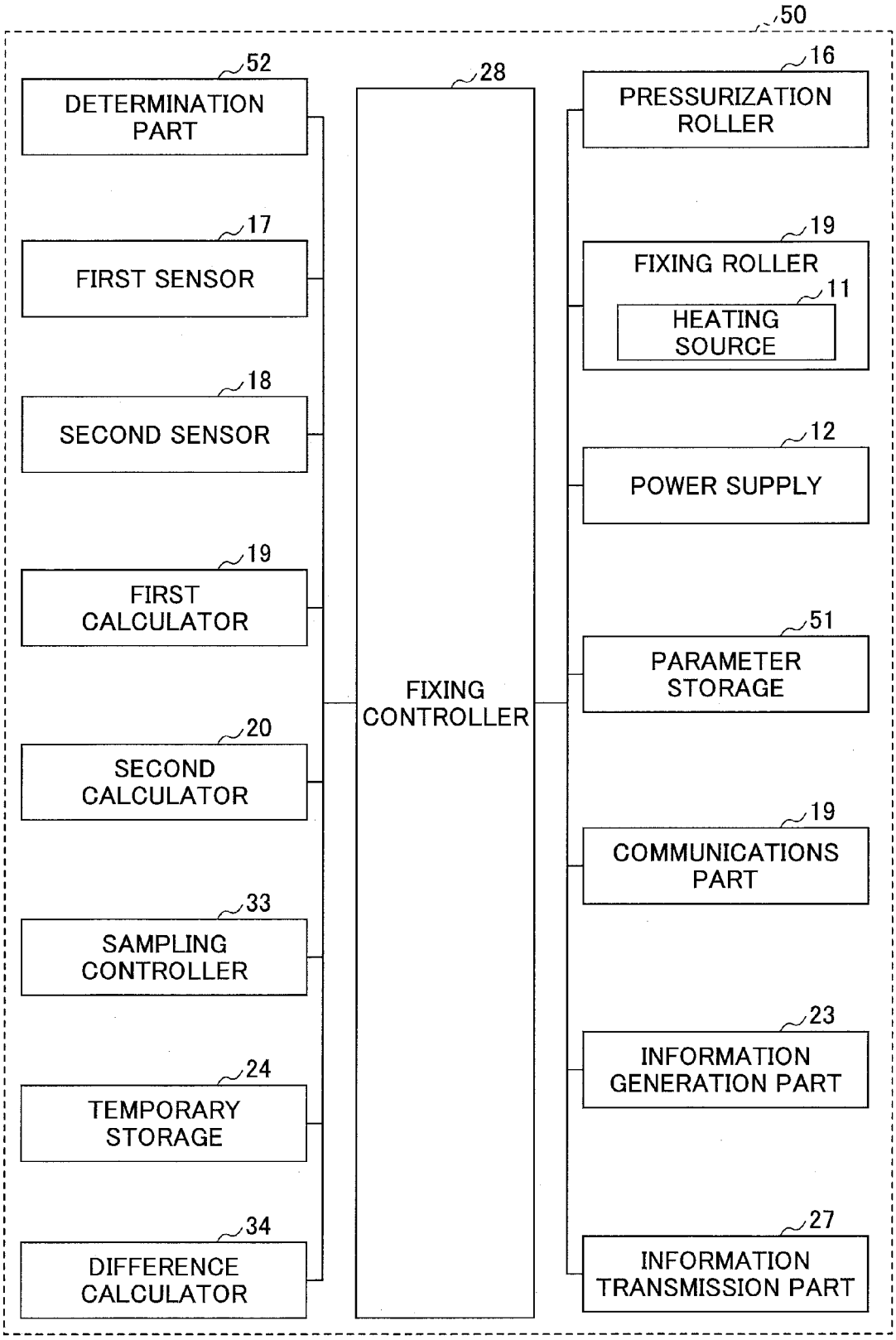
FIG. 9 is a block diagram of a fixing device according to Embodiment 2 of the present invention.

FIG. 9 is a block diagram of a fixing device according to Embodiment 2 of the present invention.

As shown in FIG. 9, a fixing device 50 according to Embodiment 2 comprises a fixing roller 29, a heating source 11, a pressurization roller 16, a power supply 12, a first sensor 17, a second sensor 18, a first calculator 19, a second calculator 20, a parameter storage 51, a determination part 52, a temporary storage 24, an information generation part 23, an information transmission part 27, a difference calculator 34, and a fixing controller 28 used to control them.

The difference calculator 34 is used to calculate, at a time point t during a process of starting the heating source 11, an absolute difference of a first temperature gradient $\Delta Tc_t$ and the second temperature gradient $\Delta Tm_t$ to serve as a temperature gradient difference $\Delta Tcm_t$, i.e., $\Delta Tcm_t=|\Delta Tc_t-\Delta Tm_t|$. The temperature gradient difference ΔTcm is calculated by the following.

When t=1.6, the temperature gradient difference is $\Delta Tcm_{1.6}=|\Delta Tc_{1.6}-\Delta Tm_{1.6}|$;

When t=1.7, the temperature gradient difference is $\Delta Tcm_{1.7}=|\Delta Tc_{1.7}-\Delta Tm_{1.7}|$;

When t=1.8, the temperature gradient difference is $\Delta Tcm_{1.0}=|\Delta Tc_{1.8}-\Delta Tm_{1.8}|$;

. . . ; and

When t=t, the temperature gradient difference is $\Delta Tcm_t=|\Delta Tc_t-\Delta Tm_t|$.

The parameter storage 51 is used to store a first temperature gradient threshold $\Delta T_1$, a second temperature gradient threshold $\Delta T_2$, a third temperature gradient threshold $\Delta T_3$, a predetermined threshold M, a predetermined sampling frequency v, a predetermined start time $t_p$, a maximum number of sampling times $n_0$, a predetermined waiting time $t_w$, etc.

The third temperature gradient threshold $\Delta T_3$ is predetermined on the basis of the temperature gradient difference ΔTcm of the fixing roller 29 when the heating source 11 is started by 110% of predetermined voltage (for example, 220~264 V) and at the same time, a paper jam occurs, or is predetermined on the basis of the temperature gradient difference ΔTcm of the fixing roller 29 when the heating source 11 is started by 85% of predetermined voltage (for example, 170~204 V) and at the same time, a paper jam does not occur.

The predetermined sampling frequency v is a sampling frequency of the first sensor 17 and the second sensor 18. For example, v is 10 Hz. Namely, during the process of starting the heating source 11, the first sensor 17 detects the first temperature Tc every 0.1 seconds, and simultaneously, the second sensor 18 also detects the second temperature Tm every 0.1 seconds.

The determination part 52 determines whether the second temperature gradient ΔTm is greater than the second temperature gradient threshold $\Delta T_2$; determines whether the temperature gradient difference ΔTcm is greater than the third temperature gradient threshold $\Delta T_3$; determines whether the count value m is greater than the predetermined threshold M; determines whether the number of sampling times reaches the maximum number of sampling times $n_0$; and then, on the basis of the determination results, controls the related parts of the fixing roller 50.

Figure 10:
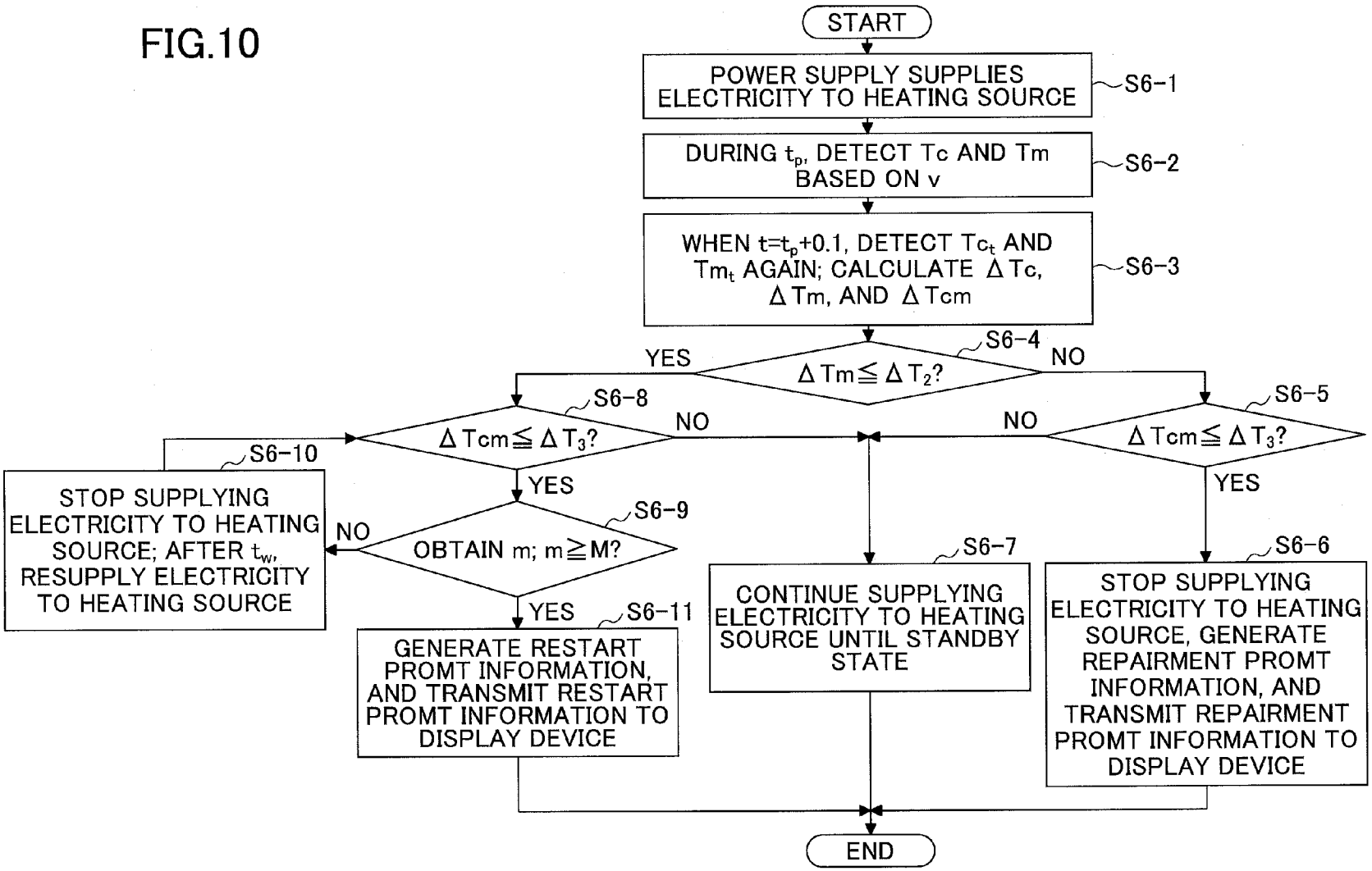
FIG. 10 is a flowchart of a fixing roller state detection method according to Embodiment 2 of the present invention.

FIG. 10 is a flowchart of a fixing roller state detection method according to Embodiment 2 of the present invention.

As shown in FIG. 10, the fixing roller state detection method according to Embodiment 2 of the present invention comprises the following steps.

STEP S6-1:

After an electrical source 26 of the image formation device 1 is started, or after the image formation device 1 in a standby state is awakened, the power supply 12 supplies the electricity to the heating source 11. After that, STEP S6-2 will be conducted.

STEP S6-2:

During the predetermined start time $t_p$, a sampling controller 33 controls the first sensor 17 to detect, on the basis of the predetermined sampling frequency v, a first temperature Tc, controls the second sensor 18 to detect, on the basis of the predetermined sampling frequency v, a second temperature Tm, and then lets the detected data be stored in the temporary storage 24. After that, STEP S6-3 will be conducted.

STEP S6-3:

When $t=t_p+0.1$, the sampling controller 33 controls the second sensor 18 to detect once a second temperature $Tm_{(tp+0.1)}$, controls the first sensor 17 to detect once a first temperature $Tc_{(tp+0.1)}$, and then lets the second temperature $Tm_{(tp+0.1)}$ and the first temperature $Tc_{(tp+0.1)}$ be stored in the temporary storage 24, respectively. After the predetermined start time $t_p$, the first and second calculators 19 and 20 calculate first and second temperature gradients $\Delta Tc_{(tp+0.1)}$ and $\Delta Tm_{(tp+0.1)}$ at the time point $t_p+0.1$, and stores the calculated data in the temporary storage 24, respectively. The difference calculator 34 calculates a temperature gradient difference $\Delta Tcm_{(tp+0.1)}$ at the time point $t_p+0.1$, and stores the calculated data in the temporary storage 24. After that, STEP S6-4 will be conducted.

STEP S6-4:

The determination part 52 reads, from the parameter storage 51, the second temperature gradient threshold $\Delta T_2$, reads, from the temporary storage 24, the second temperature gradient $\Delta Tm_{(tp+0.1)}$, and determines whether the second temperature gradient $\Delta Tm_{(tp+0.1)}$ is greater than the second temperature gradient threshold $\Delta T_2$. If it is determined that the second temperature gradient $\Delta Tm_{(tp+0.1)}$ is greater than second temperature gradient threshold $\Delta T_2$, that means at this time, the actual voltage supplied by the electrical source 26 is normal, then STEP S6-5 will be conducted. If it is determined that the second temperature gradient $\Delta Tm_{(tp+0.1)}$ is less than or equal to the second temperature gradient threshold $\Delta T_2$, that means at this time, the actual voltage supplied by the electrical source 26 is too low, then STEP S6-8 will be conducted.

STEP S6-5:

The determination part 52 reads, from the parameter storage 51, the third temperature gradient threshold $\Delta T_3$, reads, from the temporary storage 24, the temperature gradient difference $\Delta Tcm_{(tp+0.1)}$, and determines whether the temperature gradient difference $\Delta Tcm_{(tp+0.1)}$ is greater than the third temperature gradient threshold $\Delta T_3$. If it is determined that the temperature gradient difference $\Delta Tcm_{(tp+0.1)}$ is less than or equal to the third temperature gradient threshold $\Delta T_3$, that means at this time, perhaps an malfunction such as a paper jam has occurred in a paper passing zone 31, then STEP S6-6 will be conducted. If it is determined that the temperature gradient difference $\Delta Tcm_{(tp+0.1)}$ is greater than the third temperature gradient threshold $\Delta T_3$, that means at this time, a paper jam does not occur in the paper passing zone 31, then STEP S6-7 will be conducted.

STEP S6-6:

The determination part 52 determines that a fatal error (SC) occurs around the fixing roller 29, and the power supply 12 stops supplying the electricity to the heating source 11. Simultaneously, the information generation part 23 generates repairment prompt information indicating that perhaps a paper jam has occurred and the image formation device 1 needs to be repaired. The information transmission part 27 transmits the repairment prompt information to a display device 7 for display. After that, the fixing roller state detection method ends.

STEP S6-7:

The power supply 12 continues supplying the electricity to the heating source 11 until entering a standby state.

STEP S6-8:

The determination part 52 reads, from the parameter storage 51, the third temperature gradient threshold $\Delta T_3$, reads, from the temporary storage 24, the temperature gradient difference $\Delta Tcm_{(tp+0.1)}$, and determines whether the temperature gradient difference $\Delta Tcm_{(tp+0.1)}$ is greater than the third temperature gradient threshold $\Delta T_3$. If it is determined that the temperature gradient difference $\Delta Tcm_{(tp+0.1)}$ is less than or equal to the third temperature gradient threshold $\Delta T_3$, that means at this time, in the paper passing zone 31, perhaps a paper jam has occurred, then STEP S6-9 will be conducted. If it is determined that the temperature gradient difference $\Delta Tcm_{(tp+0.1)}$ is greater than the third temperature gradient threshold $\Delta T_3$, that means at this time, in the paper passing zone 31, a paper jam has not occurred, then STEP S6-7 will be conducted.

STEP S6-9:

The determination part 52 continues to determine plural times whether the temperature gradient difference $\Delta Tcm_{(tp+0.1)}$ is greater than the third temperature gradient threshold $\Delta T_3$; lets the number of times, that the temperature gradient difference $\Delta Tcm_{(tp+0.1)}$ is continuously greater than or equal to the third temperature gradient threshold $\Delta T_3$, serve as a count value m; and stores the count value m in the temporary storage 24. The determination part 52 continues to read, from the temporary storage 24, the count value m, reads, from the parameter storage 51, the predetermined threshold M, and determines whether the count value m is greater than or equal to predetermined threshold M. If a determination result is obtained which indicates that the count value m is greater than or equal to the predetermined threshold M, then STEP S6-11 will be conducted. If a determination result is obtained which indicates that the count value m is less than the predetermined threshold M, then STEP S6-10 will be conducted.

STEP S6-10:

The power supply 12 stops supplying the electricity to the heating source 11. After the predetermined waiting time $t_w$, the power supply 12 resupplies the electricity to the heating source 11 so that the heating source 11 is restarted. After that, STEP S6-8 will be conducted.

STEP S6-11:

The information generation part 23 determines, on the basis of the determination result indicating that the count value m is greater than or equal to the predetermined threshold M, the actual voltage is too low, and generates restart prompt information indicating that the actual voltage of the electrical source 26 is too low and the image formation device 1 needs to be restarted. The information transmission part 27 transmits the restart prompt information to the display device 7 for display. After that, the fixing roller state detection method ends.

Figure 11:
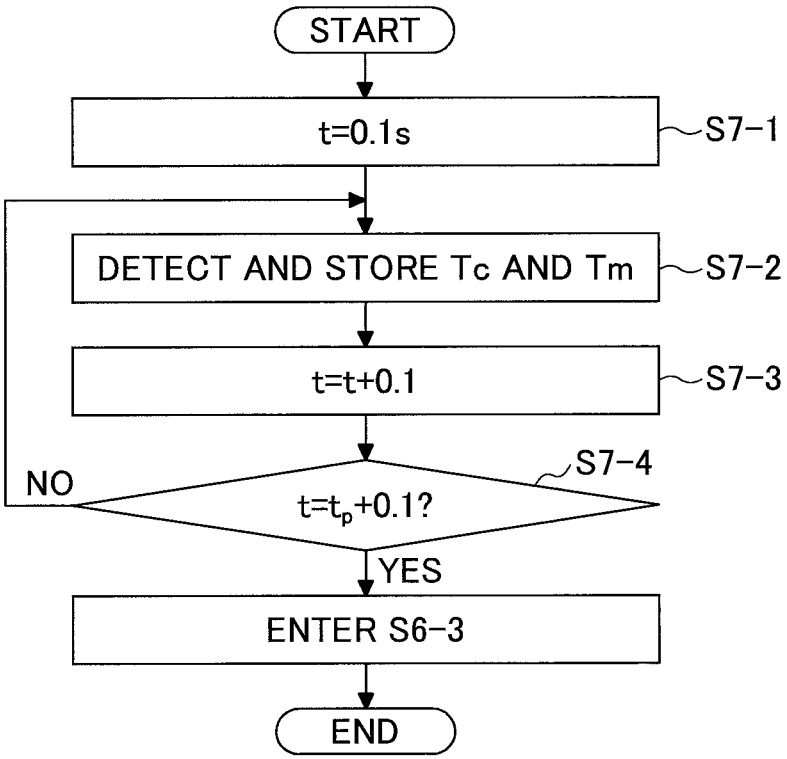
FIG. 11 is a flowchart of STEP S6-2 of the fixing roller state detection method according to Embodiment 2 of the present invention.

FIG. 11 is a flowchart of STEP S6-2 of the fixing roller state detection method according to Embodiment 2 of the present invention.

As shown in FIG. 11, STEP S6-2 of the fixing roller state detection method according to Embodiment 2 of the present invention comprises the following steps.

STEP S7-1:

If a current time t=0.1 seconds, i.e., if t reaches a time point when the first sensor 17 and the second sensor 18 respectively start to detect first samples, then STEP S7-2 will be conducted.

STEP S7-2:

The first sensor 17 and the second sensor 18 detect, on the basis of the predetermined sampling frequency v, a first temperature Tc and a second temperature Tm, and store the detected first temperature Tc and the second temperature Tm in the temporary storage 24, respectively. After that, STEP S7-3 will be conducted.

STEP S7-3:

After the current time t reaches t+0.1 seconds, STEP S7-4 will be conducted.

STEP S7-4:

The determination part 52 determines whether the current time $t=t_p+0.1$ ($t_p$ it the predetermined start time). Before $t=t_p+0.1$, STEP S7-2 is conducted repeatedly. If $t=t_p+0.1$, then STEP S6-3 will be conducted.

Figure 12:
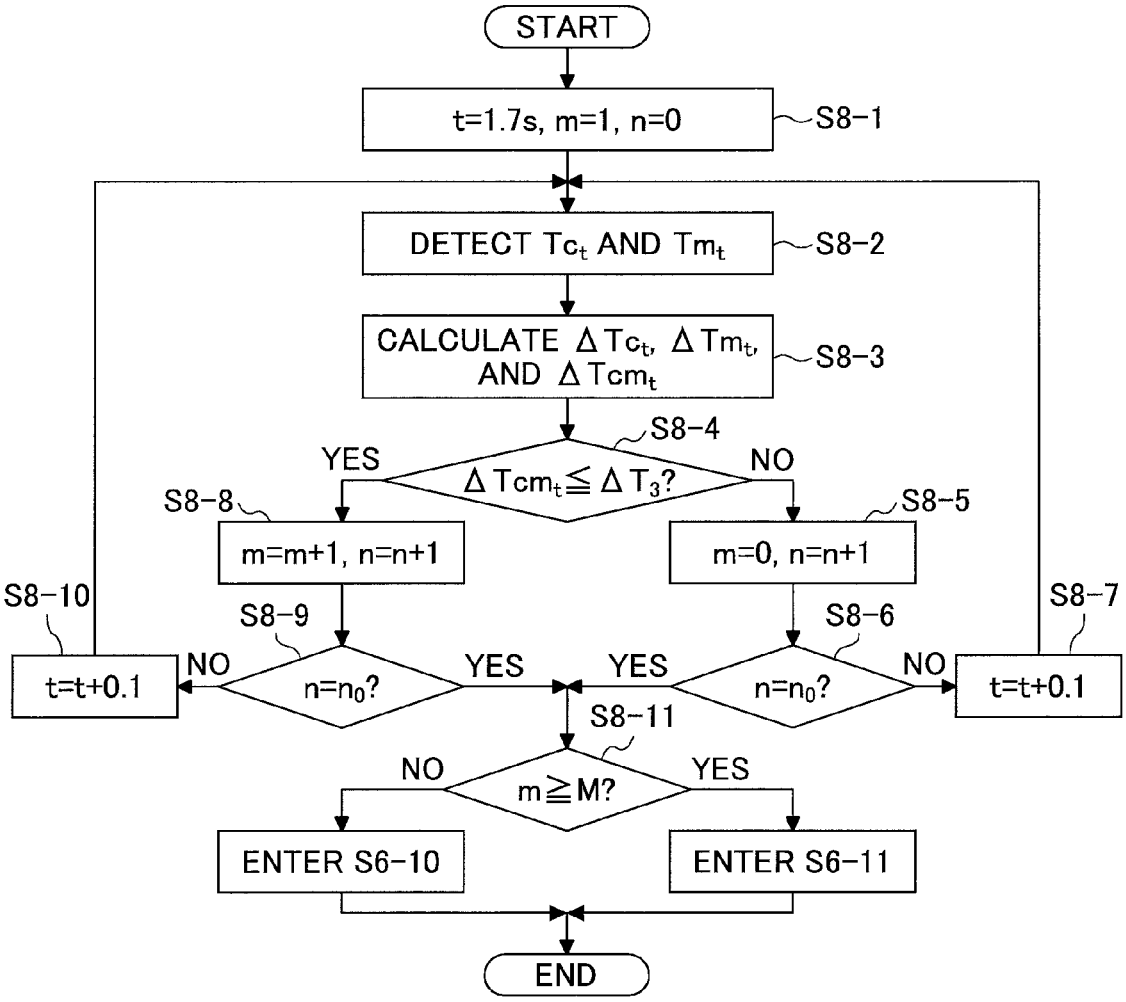
FIG. 12 is a flowchart of STEP S6-9 of the fixing roller state detection method according to Embodiment 2 of the present invention.

FIG. 12 is a flowchart of STEP S6-9 of the fixing roller state detection method according to Embodiment 2 of the present invention.

As shown in FIG. 12, STEP S6-9 of the fixing roller state detection method according to Embodiment 2 of the present invention comprises the following steps.

STEP S8-1:

The current time t reaches 1.7 seconds, a count value m is 1, and the number of sampling times n is reset to 0. After that, STEP S8-2 will be conducted.

STEP S8-2:

The sampling controller 33 controls the first sensor 17 to detect once a first temperature $Tc_t$ at a time point t, and to store the first temperature $Tc_t$ in the temporary storage 24. Simultaneously, The sampling controller 33 controls the second sensor 18 to detect once a second temperature $Tm_t$ at the time point t, and to store the first temperature $Tm_t$ in the temporary storage 24. After that, STEP S8-3 will be conducted.

STEP S8-3:

The first calculator 19 calculates, at the time point t, a first temperature gradient $\Delta Tc_t=Tc_t-Tc_{(t-1.5)}$; the second calculator 20 calculates, at the time point t, the second temperature gradient $\Delta Tm_t=Tm_t-Tm_{(t-1.5)}$; and the difference calculator 34 calculates, at the time point t, a temperature gradient difference $\Delta Tcm_t$. After that, STEP S8-4 will be conducted.

STEP S8-4:

The determination part 52 reads, from the parameter storage 51, the third temperature gradient threshold $\Delta T_3$, reads, from the temporary storage 24, the temperature gradient difference $\Delta Tcm_t$, and determines whether the temperature gradient difference $\Delta Tcm_t$ is greater than the third temperature gradient threshold $\Delta T_3$. If it is determined that the temperature gradient difference $\Delta Tcm_t$ is less than or equal to the third temperature gradient threshold $\Delta T_3$, then STEP S8-8 will be conducted. If it is determined that the temperature gradient difference $\Delta Tcm_t$ is greater than the third temperature gradient threshold $\Delta T_3$, that means at this time, it does not occur that the first temperature gradient $\Delta Tc_t$ is continuously greater than or equal to the first temperature gradient threshold $\Delta T_1$, then STEP S8-5 will be conducted.

STEP S8-5:

The count value m is reset to 0, and the number of sampling times n=n+1. After that, STEP S8-6 will be conducted.

STEP S8-6:

The determination part 52 determines whether the number of sampling times n is greater than or equal to the maximum number of sampling times $n_0$. If it is determined that the number of sampling times n is less than the maximum number of sampling times $n_0$, then STEP S8-7 will be conducted. If it is determined that the number of sampling times n is greater than or equal to the maximum number of sampling times $n_0$, then STEP S8-11 will be conducted.

STEP S8-7:

The current time t=t+0.1 seconds. After that, STEP S8-2 will be conducted.

STEP S8-8:

The count value m=m+1, and the sampling times n=n+1. After that, STEP S8-9 will be conducted.

STEP S8-9:

The determination part 52 determines whether the number of sampling times n is greater than or equal to the maximum number of sampling times $n_0$. If it is determined that the number of sampling times n is less than the maximum number of sampling times $n_0$, then STEP S8-10 will be conducted. If it is determined that the number of sampling times n is greater than or equal to the maximum number of sampling times $n_0$, then STEP S8-11 will be conducted.

STEP S8-10:

The current time t=t+0.1 seconds. After that, STEP S8-2 will be conducted.

STEP S8-11:

The determination part 52 determines whether the count value m is greater than or equal to predetermined threshold M. If a determination result is obtained which indicates that the count value m is greater than or equal to predetermined threshold M, then STEP S6-11 (see FIG. 10) will be conducted. If a determination result is obtained which indicates that the count value m is less than the predetermined threshold M, then STEP S6-10 will be conducted.

Figure 13:
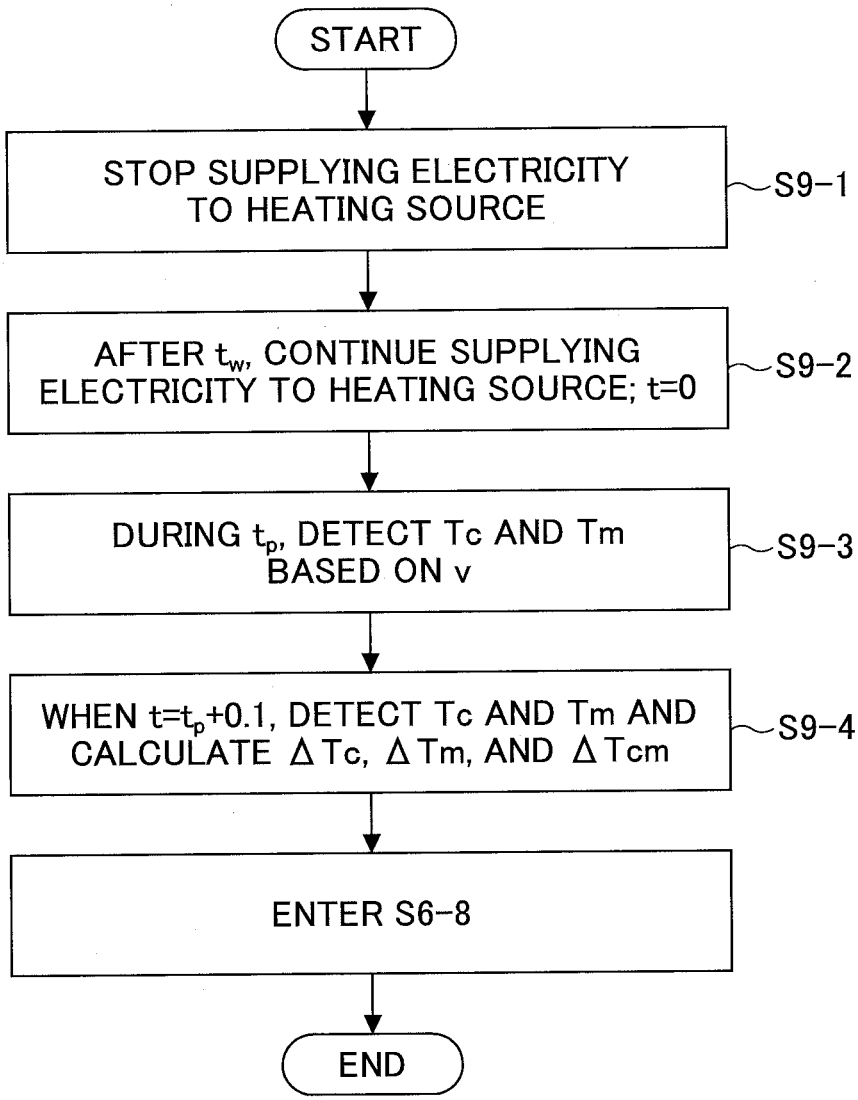
FIG. 13 is a flowchart of STEP S6-10 of the fixing roller state detection method according to Embodiment 2 of the present invention.

FIG. 13 is a flowchart of STEP S6-10 of the fixing roller state detection method according to Embodiment 2 of the present invention.

As shown in FIG. 13, STEP S6-10 of the fixing roller state detection method according to Embodiment 2 of the present invention comprises the following steps.

STEP S9-1:

The power supply 12 stops supplying the electricity to the heating source 11. After that, STEP S9-2 will be conducted.

STEP S9-2:

The power supply 12 resupplies, after the predetermined waiting time $t_w$, the electricity to the heating source 11 so that the heating source 11 is restarted. Simultaneously, the current time t is reset to 0. After that, STEP S9-3 will be conducted.

STEP S9-3:

During the predetermined start time $t_p$, the sampling controller 33 controls the first sensor 17 to detect, on the basis of the predetermined sampling frequency v, a first temperature Tc; controls the second sensor 18 to detect, on the basis of the predetermined sampling frequency v, a second temperature Tm; and lets the detected data be stored in the temporary storage 24. After that, STEP S9-4 will be conducted.

STEP S9-4:

After the predetermined start time $t_p$, when $t=t_p+0.1$, the first calculator 19 calculates the corresponding first temperature gradient $\Delta Tc_{(tp+0.1)}$; the second calculator 20 calculates the corresponding first temperature gradient $\Delta Tm_{(tp+0.1)}$; the difference calculator 34 calculates, on the basis of the first temperature gradient $\Delta Tc_{(tp+0.1)}$ and the first temperature gradient $\Delta Tm_{(tp+0.1)}$, a temperature gradient difference $\Delta Tcm_{(tp+0.1)}$; and stores the calculated data in the temporary storage 24. After that, STEP S6-8 will be conducted.

<Function and Effect of Embodiment 2>

In the fixing device and image formation device according to this embodiment, the determination method on the basis of the temperature gradient difference ΔTcm and the third temperature gradient threshold $\Delta T_3$ is adopted. As a result, when carrying out the determination, it is possible to simultaneously use a first temperature gradient and a second temperature gradient at the same time. In this way, it is possible to improve the determination accuracy.

While the present invention is described with reference to the specific embodiments chosen for purpose of illustration, it should be apparent that the present invention is not limited to these embodiments, but numerous modifications could be made thereto by those people skilled in the art without departing from the basic concept and technical scope of the present invention.

The present application is on the basis of and claims the benefit of priority of Chinese Priority Patent Application No. 201310484908.X filed on Oct. 16, 2013, the entire contents of which are hereby incorporated by reference.

What is claimed is:

1. A fixing device communicatingly connected to a display device, installed in an image formation device to which electricity is supplied by an electrical source, and having a fixing roller in which there is a heating source, wherein, the fixing roller has a paper passing zone located in a middle portion of the fixing roller and non-paper passing zones, one located at each end of the fixing roller, the fixing device comprising:

a first sensor used to detect a temperature of the paper passing zone to serve as a first temperature;

a second sensor used to detect a temperature of one of the non-paper passing zones to serve as a second temperature;

a first calculator used to calculate, during a process of starting the heating source, a surface temperature rise value based on the first temperature in a predetermined time period to serve as a first temperature gradient;

a second calculator used to calculate, during the process of starting the heating source, a surface temperature rise value based on the second temperature in the predetermined time period to serve as a second temperature gradient;

a parameter storage used to store at least first and second temperature gradient thresholds;

a determination part used to determine whether the second temperature gradient is greater than the second temperature gradient threshold, wherein, if it is determined that the second temperature gradient is less than or equal to the second temperature gradient threshold, then to determine that a voltage of the electrical source is too low, and to continue to determine at least once whether the first temperature gradient is greater than the first temperature gradient threshold, so as to get a determination result;

an information generation part used to generate, based on the determination result, restart prompt information indicating that the image formation device needs to be restarted because the voltage of the electrical source is too low; and an information transmission part used to transmit the restart prompt information to the display device.

2. The fixing device according to claim 1, further comprising:

a sampling controller used to control, after the heating source is started, the first sensor to detect the first temperature based on a predetermined sampling frequency, wherein, the parameter storage further stores a predetermined threshold;

after a predetermined start time, the first calculator calculates the first temperature gradient plural times based on the predetermined sampling frequency;

after it is determined that the voltage of the electrical source is too low, the determination part continues to determine plural times whether the first temperature gradient is greater than the first temperature gradient threshold, and at the same time, the determination part lets a number of times, that the first temperature gradient is continuously greater than or equal to the first temperature gradient threshold, serve as a count value, and determines whether the count value is greater than or equal to the predetermined threshold; and if the determination result is obtained which indicates that the count value is greater than or equal to the predetermined threshold, then the information generation part generates the restart prompt information based on the determination result.

3. The fixing device according to claim 2, further comprising:

a power supply used to supply the electricity to the heating source, wherein, the heating source corresponds to a predetermined voltage, and is started by an actual voltage supplied by the electrical source, wherein, if the determination result is obtained which indicates that the count value is less than the predetermined threshold, then the power supply stops supplying the electricity to the heating source; and after a predetermined waiting time, the power supply resupplies the electricity to the heating source so that the heating source is restarted.

4. The fixing device according to claim 3, wherein:

the predetermined time period is 1.5 seconds, the predetermined sampling frequency is 10 Hz, the predetermined start time is 1.5 seconds, and the predetermined waiting time is less than 2 minutes;

the first temperature gradient threshold is predetermined based on the first temperature gradient of the fixing roller when a paper jam occurs under 110% of the predetermined voltage, or is predetermined based on the first temperature gradient of the fixing roller when a paper jam does not occur under 85% of the predetermined voltage; and the second temperature gradient threshold is predetermined based on the second temperature gradient of the fixing roller when the heating source is started by 85~90% of the predetermined voltage.

5. An image formation device comprising the fixing device according to claim 1.

6. A fixing roller state detection method of detecting a temperature of a fixing roller in a fixing device communicatingly connected to a display device, installed in an image formation device to which electricity is supplied by an electrical source, and having a fixing roller in which there is a heating source, wherein, the fixing roller has a paper passing zone located in a middle portion of the fixing roller and non-paper passing zones, one located at each end of the fixing roller, the fixing roller state detection method comprising:

a step of setting first and second sensors in the paper passing zone and one of the non-paper passing zones, respectively;

a step of detecting, by adopting the first and second sensors, temperatures of the paper passing zone and the one of the non-paper passing zones to serve as first and second temperatures, respectively;

a step of calculating, by adopting first and second calculators, surface temperature rise values based on the first and second temperatures in a predetermined time period during a process of starting the heating source to serve as first and second temperature gradients, respectively;

a step of storing, by adopting a parameter storage, at least first and second temperature gradient thresholds;

a step of determining, by adopting a determination part, whether the second temperature gradient is greater than the second temperature gradient threshold, wherein, if it is determined that the second temperature gradient is less than or equal to the second temperature gradient threshold, then determining that a voltage of the electrical source is too low, and continuing to determine at least once whether the first temperature gradient is greater than the first temperature gradient threshold, so as to obtain a determination result;

a step of generating based on the determination result, by adopting an information generation part, restart prompt information indicating that the image formation device needs to be restarted because the voltage of the electrical source is too low; and a step of transmitting, by adopting an information transmission part, the restart prompt information to the display device.

7. The fixing roller state detection method according to claim 6, further comprising a step of:

controlling, by adopting a sampling controller, the first sensor to detect the first temperature based on a predetermined sampling frequency;

after a predetermined start time, by adopting the first calculator, calculating the first temperature gradient plural times based on the predetermined sampling frequency;

after it is determined that the voltage of the electrical source is too low, by adopting the determination part, continuing to determine plural times whether the first temperature gradient is greater than the first temperature gradient threshold, and at the same time, letting a number of times, that the first temperature gradient is continuously greater than or equal to the first temperature gradient threshold, serve as a count value, and determining whether the count value is greater than or equal to a predetermined threshold; and after the determination result is obtained which indicates that the count value is greater than or equal to the predetermined threshold, by adopting the information generation part, generating the restart prompt information based on the determination result.

8. The fixing roller state detection method according to claim 7, further comprising a step of:

stopping, after the determination result is obtained which indicates that the count value is less than the predetermined threshold, supplying the electricity to the heating source from a power supply; and after a predetermined waiting time, resupplying the electricity to the heating source from the power supply so that the heating source is restarted.

9. A fixing device communicatingly connected to a display device, installed in an image formation device to which electricity is supplied by an electrical source, and having a fixing roller in which there is a heating source, wherein, the fixing roller has a paper passing zone located at a middle portion of the fixing roller and non-paper passing zones, one located in each end of the fixing roller, the fixing device comprising:

a first sensor used to detect a temperature of the paper passing zone to serve as a first temperature;

a second sensor used to detect a temperature of one of the non-paper passing zones to serve as a second temperature;

a first calculator used to calculate, during a process of starting the heating source, a surface temperature rise value based on the first temperature in a predetermined time period to serve as a first temperature gradient;

a second calculator used to calculate, during the process of starting the heating source, a surface temperature rise value based on the second temperature in the predetermined time period to serve as a second temperature gradient;

a difference calculator used to calculate, during the process of starting the heating source, an absolute difference of the first and second temperature gradients to serve as a temperature gradient difference;

a parameter storage used to store at least second and third temperature gradient thresholds;

a determination part used to determine whether the second temperature gradient is greater than the second temperature gradient threshold, wherein, if it is determined that the second temperature gradient is less than or equal to the second temperature gradient threshold, then to determine that a voltage of the electrical source is too low, and to continue to determine at least once whether the temperature gradient difference is greater than the third temperature gradient threshold, so as to obtain a determination result;

an information generation part used to generate, based on the determination result, restart prompt information indicating that the image formation device needs to be restarted because the voltage of the electrical source is too low; and an information transmission part used to transmit the restart prompt information to the display device.

10. The fixing device according to claim 9, further comprising:

a sampling controller used to control, after the heating source is started, the first and second sensors to respectively detect the first and second temperatures based on a predetermined sampling frequency, wherein, the parameter storage further stores a predetermined threshold;

after a predetermined start time, the first and second calculators respectively calculate the first and second temperature gradients plural times based on the predetermined sampling frequency;

the difference calculator calculates the temperature gradient difference plural times based on the basis of the predetermined sampling frequency;

after it is determined that the voltage of the electrical source is too low, the determination part continues to determine plural times whether the temperature gradient difference is greater than the third temperature gradient threshold, and at the same time, the determination part lets a number of times, that the temperature gradient difference is continuously greater than or equal to the third temperature gradient threshold, serve as a count value, and determines whether the count value is greater than or equal to the predetermined threshold; and if the determination result is obtained which indicates that the count value is greater than or equal to the predetermined threshold, then the information generation part generates the restart prompt information based on the determination result.

11. The fixing device according to claim 10, further comprising:

a power supply used to supply the electricity to the heating source, wherein, the heating source corresponds to a predetermined voltage, and is started by an actual voltage supplied by the electrical source, wherein, after the determination result is obtained which indicates that the count value is less than the predetermined threshold, the power supply stops supplying the electricity to the heating source; and after a predetermined waiting time, the power supply resupplies the electricity to the heating source so that the heating source is restarted.

12. The fixing device according to claim 11, wherein:

the predetermined time period is 1.5 seconds, the predetermined sampling frequency is 10 Hz, the predetermined start time is 1.5 seconds, and the predetermined waiting time is less than 2 minutes;

the second temperature gradient threshold is predetermined based on the second temperature gradient of the fixing roller when the heating source is started under 85~90% of the predetermined voltage; and the third temperature gradient threshold is predetermined based on the temperature gradient difference of the fixing roller when a paper jam occurs under 110% of the predetermined voltage, or is predetermined based on the temperature gradient difference of the fixing roller when a paper jam does not occur under 85% of the predetermined voltage.

13. An image formation device comprising the fixing device according to claim 9.

* * * * *